US008081773B2

(12) United States Patent
Daishin et al.

(10) Patent No.: US 8,081,773 B2
(45) Date of Patent: Dec. 20, 2011

(54) AUDIO SIGNAL PROCESSING APPARATUS, AUDIO SIGNAL PROCESSING METHOD AND IMAGING APPARATUS

(75) Inventors: Takuya Daishin, Kanagawa (JP); Yoshitaka Miyake, Kanagawa (JP); Kaoru Gyotoku, Kanagawa (JP)

(73) Assignee: Sony Corporation (JP)

( * ) Notice: Subject to any disclaimer, the term of this patent is extended or adjusted under 35 U.S.C. 154(b) by 1034 days.

(21) Appl. No.: 12/002,882

(22) Filed: Dec. 19, 2007

(65) Prior Publication Data

US 2008/0152154 A1 Jun. 26, 2008

(30) Foreign Application Priority Data

Dec. 25, 2006 (JP) ..... P2006-348376

(51) Int. Cl.
*H04R 3/00* (2006.01)

(52) U.S. Cl. ..... 381/92; 381/91; 381/26

(58) Field of Classification Search ..... 381/91–92, 381/26, 356, 387

See application file for complete search history.

(56) References Cited

U.S. PATENT DOCUMENTS

| | | | | |
|---|---|---|---|---|
| 6,041,127 | A | 3/2000 | Elko | |
| 7,324,649 | B1 * | 1/2008 | Knapp et al. | 381/313 |
| 7,340,067 | B2 * | 3/2008 | Murase et al. | 381/92 |

FOREIGN PATENT DOCUMENTS

| | | |
|---|---|---|
| EP | 458575 | 11/1991 |
| JP | 5-191886 A | 7/1993 |
| JP | 2000197177 | 7/2000 |
| JP | 2002171591 | 6/2002 |
| JP | 2002-218583 A | 8/2002 |
| JP | 2002-223493 A | 8/2002 |
| JP | 2002-232988 A | 8/2002 |
| JP | 2005341073 | 12/2005 |

* cited by examiner

*Primary Examiner* — Theresa T Doan

(74) *Attorney, Agent, or Firm* — Lerner, David, Littenberg, Krumholz & Mentlik, LLP

(57) ABSTRACT

An audio signal processing apparatus includes first, second and third omni-directional microphones each of which receives sound and generates an omni-directional audio signal and which are spaced apart by a predetermined distance, a first adder section that adds audio signals generated by the first, second and third omni-directional microphones and generates an audio signal having an omni-directivity in the whole circumferential direction, a first subtractor section that subtracts audio signals generated by the first and third omni-directional microphones and generates an audio signal having a directivity in the right-left direction, a second adder section that adds audio signals generated by the first and third omni-directional microphones, a second subtractor section that subtracts an audio signal generated by the second omni-directional microphone from the audio signal added by the second adder section and generates an audio signal having a directivity in the front-back direction, and an output section that adds the audio signal resulting from the multiplication of the audio signal having a directivity in the whole circumferential direction by a predetermined coefficient, the audio signal resulting from the multiplication of the audio signal having a directivity in the right-left direction by a predetermined coefficient, and the audio signal resulting from the multiplication of the audio signal having a directivity in the front-back direction by a predetermined coefficient and generates a unidirectional audio signal.

8 Claims, 21 Drawing Sheets

EXAMPLE OF FREQUENCY CHARACTERISTIC

EXAMPLE OF DIRECTIVITY

AUDIO SIGNAL PROCESSING APPARATUS, AUDIO SIGNAL PROCESSING METHOD AND IMAGING APPARATUS

CROSS-REFERENCE TO RELATED APPLICATIONS

The present application claims priority from Japanese Patent Application No. JP 2006-348376 filed in the Japanese Patent Office on Dec. 25, 2006, the entire content of which is incorporated herein by reference.

BACKGROUND OF THE INVENTION

1. Field of the Invention

The present invention relates to an audio signal processing apparatus, audio signal processing method and imaging apparatus suitable for the application for recording surround 5.1 channel audio signals, for example.

2. Description of the Related Art

In the past, various audio players have been proposed for enjoying audio of a radio program or on a music CD (Compact Disc) or a DVD (Digital Versatile Disk), for example, indoors. These audio players can play a surround-recorded sound source by using a surround technology for implementing a sound field similar to a movie theater or a surround technology for implementing a sound field similar to a music hall.

For example, a (5.1 channel) surround system in the past has five channel speakers of, about a listener, Front Left (FL) and Front Right (FR) at the front, rear left Surround Left (SL), rear right Surround Right (SR) and Front Center (FC) and a 0.1 channel sub woofer (SW). This surround system implements the surround playback in sound supporting 5.1 channels around a listener.

By the way, in order to implement the surround playback, surround recording in sound suitable for the speaker characteristics is desired when recording. In the past, various recording technologies have been used for implementing the surround sound recording.

JP-A-5-191886 (Patent Document 1) discloses a surround sound microphone system that collects sound in 360° sound source directions through a first microphone having non-directivity and a second to fourth microphones having directivity exhibiting cardioid curves.

JP-A-2002-232988 (Patent Document 2) discloses a multi-channel sound-collecting apparatus that synthesizes five directional microphone sounds having directivities of the front left, front right, rear right, rear left and front from the output of three non-directional microphones.

JP-A-2002-218583 (Patent Document 3) discloses a field sound synthesis computing method and apparatus, which corrects the sensitivity for a low frequency of a near sound and uses an extracted near sound to reduce touch noise and/or wind noise.

SUMMARY OF THE INVENTION

By the way, five microphones are used for implementing the surround recording in sound supporting 5.1 channels in the past. Therefore, there was a problem such as increase in the mount area and/or costs for implementing five microphones. In addition, since directional microphones were used for recording in the past, the angles of the directivities depend on the layout of the microphones. Then, the layout of the microphones must be changed every time recording is performed at an arbitrary angle. Therefore, the demand for changing the angles of the directivities of microphones has not been met without changing the implementation form of the microphones.

For example, since the technology disclosed in Patent Document 1 employs directional microphones, it is important to determine the layout and the angles of attachment of the microphones. In, for example, a small video camera etc., the increase in the mount area for microphones is a problem in a case where the microphones to be internally contained in the body are mounted therein.

In the technology disclosed in Patent Document 2, a delay that delays by an equal time to the delay time of a sound wave to two of three microphones is used to synthesize a unidirectivity from the two microphones forming one side of the triangle. However, even by using the technology, the direction of the maximum directional sensitivity in which the directional sensitivity is at a maximum is only directed to the angle on the line of the two of three microphones. For this reason, setting a coefficient only does not allow directing the direction of the maximum directional sensitivity to an arbitrary angle. In order to define the direction of the maximum directional sensitivity to an arbitrary direction, the layout of the triangle can be required to change. In this case, the space in the cabinet for implementing the microphones is wastefully used.

In consideration of the size of microphones, the frequency band of the microphones, the thickness of a cabinet material and the space to be allocated to the sound collecting part of equipment, a case is assumed in which the distance between adjacent microphones is 10 mm. In this case, in order to obtain unidirectivity, it is important that the delay time of an internal delay is equal to the delay time of sound waves corresponding to 10 mm, which may complicate the audio signal processing circuit.

Furthermore, in order to obtain a unidirectivity exhibiting a cardioid carve, it is important to determine the delay time and the distance between microphones such that the delay time by the delay and the delay time of a sound wave caused by the distance between microphones can be a relationship of 1:1. For example, in a case where the sampling frequency is fixed, it is required to technically adjust the distance between microphones in accordance with the delay time by the delay or to adjust the delay time by the delay in accordance with the delay time caused by the distance between microphones. However, in order to obtain a unidirectivity, it is exasperated because the distance between microphones cannot be selected arbitrarily, and the layout of microphones is subject to constraints in implementation. Since the direction of the maximum directional sensitivity can be directed only to the angle on the line of two of three microphones, the unidirectivities in five directions at a maximum can be only synthesized.

Though the technology disclosed in Patent Document 3 can be used to change the back sensitivity of a unidirectivity, it is difficult to direct the unidirectivity to an arbitrary direction.

Accordingly, it is desirable to record in surround sound by using inexpensive microphones to be implemented in a smaller area.

An embodiment of the present invention includes: generating omni-directional audio signals in the whole circumferential direction by first, second and third omni-directional microphones each of which collects sound; adding audio signals generated by the first, second and third omni-directional microphones and generating an audio signal having an omni-directivity in the whole circumferential direction; subtracting audio signals generated by the first and third omni-directional microphones and generating an audio signal having a directivity in the right-left direction; adding audio signals generated by the first and third omni-directional microphones, subtracting, from the added audio signal generated by the first and third omni-directional microphones, an audio signal generated by the second omni-directional microphone and generating an audio signal having a directivity in the front-back direction; and adding the audio signal resulting from the multiplication of the audio signal having a directivity in the whole circumferential direction by a predetermined coefficient, the audio signal resulting from the multiplication of the audio signal having a directivity in the right-left direction by a predetermined coefficient, and the audio signal resulting from the multiplication of the audio signal having a directivity in the front-back direction by a predetermined coefficient and generating a unidirectional audio signal.

In this way, surround recording in sound for an arbitrary number of channels is allowed by using three omni-directional microphones and generating a unidirectional audio signal by multiplying audio signals having directivities in the circumferential, right-left and front-back directivities by predetermined coefficients.

According to the embodiment of the invention, surround recording in sound for an arbitrary number of channels is allowed by using three omni-directional microphones to synthesize a unidirectivity. Since an omni-directional microphone is inexpensive and small, the entire implementation costs and the mount area can be advantageously reduced.

DESCRIPTION OF THE PREFERRED EMBODIMENTS

With reference to FIGS. 1 to 16B, a first embodiment of the invention will be described below. This embodiment describes an example in which the invention is applied to an imaging apparatus that records external audio in surround sound.

Figure 1:
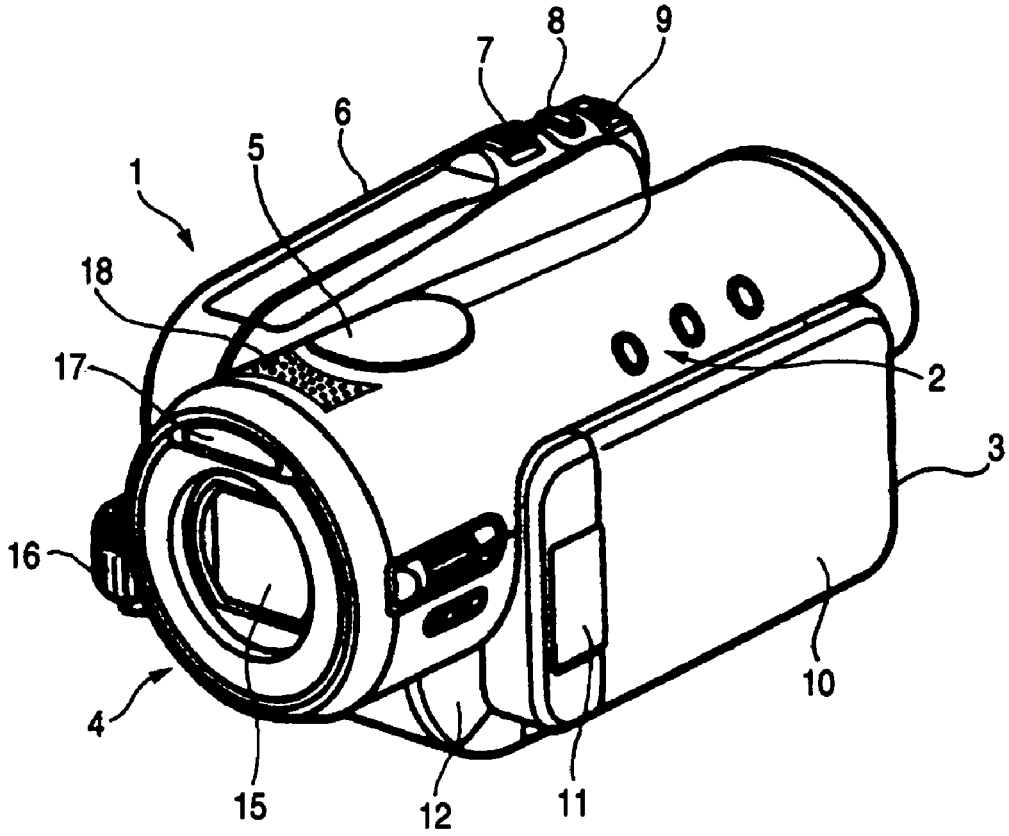
FIG. 1 is a perspective view showing an external construction example of an imaging apparatus according to a first embodiment of the invention.

First of all, with reference to FIG. 1, an imaging apparatus 1 that can digitally record images and sounds on an internal information recording medium will be described. The imaging apparatus 1 can convert an optical image to an electric signal by an imaging device 32 (refer to FIG. 2, which will be described later) such as a CMOS (complementary metal oxide semiconductor) image sensor to display on a display apparatus having a flat panel such as a liquid crystal display and/or record on an optical disk, which is an information recording medium for recording images and sounds. The information recording medium is not limited to an optical disk but may be a disk-shaped recording medium such as a magneto-optical disk and a magnetic disk, a hard disk, a magnetic tape such as a tape cassette or a semiconductor memory.

The imaging apparatus 1 includes an external case 12, an optical disk driving section, a control circuit, a lens device 4 and a display section 3. The external case 12 is a camera body that protects internal parts. The optical disk driving section is stored within the external case 12 and drives to rotate an optical disk removably installed thereto and record (write) and play (read) information signals. The control circuit may control the driving of the optical disk driving section. The lens device 4 captures image light of a subject and guides the image light to the imaging device 32. The display section 3 is rotatably attached to the external case 12.

The external case 12 is a hollow cabinet in a substantially tube shape. The display section 3 is attached to one side of the external case 12 in a manner allowing the attitude of the display section 3 to change. The display section 3 includes a panel case 10 and a panel supporting section 11. The panel case 10 stores a flat panel including a flat-shaped liquid crystal display. The panel supporting section 11 supports the panel case 10 in a manner allowing the orientation of the panel case to change against the external case 12.

The lens device 4 is placed on the front part of the external case 12. The lens device 4 has a lens barrel 31 (refer to FIG. 2) having a substantially square tube shape. A plurality of lenses including an objective lens 15 are supported in a fixed or movable manner within the lens barrel 31.

The panel case 10 is a flat cabinet, which is a substantially rectangular parallelepiped. The surface facing against one side of the external case 12 exposes the display of the flat panel. The panel supporting section 11 has a horizontally rotating section and a back-and-forth rotating section. The horizontally rotating section allows the panel case 10 to rotate horizontally by substantially 90 degrees about the vertical axis. About the horizontal axis, the back-and-forth rotating section allows the panel case 10 to rotate by about 270 degrees in total including the back-and-forth rotation by substantially 180 degrees and the additional up-and-down rotation by about 90 degrees.

Thus, the display section 3 can enter to a stored state in which the display section 3 is stored at the side of the external case 12, a state in which the panel case 10 is rotated horizontally by 90 degrees to cause the flat panel to face to the back, a state in which the panel case 10 is rotated from the state by 180 degrees to cause the flat panel to face to the front, a state in which the flat panel is rotated further to the back by 90 degrees from the state in which the flat panel is facing to the back to cause the flat panel to face down, and an arbitrary state (orientation) at a middle position among them.

A grip section 6 for gripping the external case 12 is provided on the opposite side of the display section 3 of the external case 12. The grip section 6 also functions as a cover member for a mechanical deck, not shown, stored therewithin. By opening the top of the grip section 6, an optical disk insertion slot of the internally contained mechanical deck is exposed to allow an operation of installing or removing an optical disk.

A power switch 9, a shutter button 8 and a zoom button 7 are provided at the upper back of the grip section 6. The power switch 9 also functions as a mode selection switch. The shutter button 8 is used for shooting a still image. The zoom button 7 serially zooms in (tele) or zoom out (wide) an image within a predetermined range. The power switch 9 has a function of switching on or off the power by a rotating operation thereon and a function of switching to repeat multiple function modes by a rotating operation thereon at the state that the power is on. A recording button for shooting moving pictures is provided below the power switch 9.

A hand belt 16 is attached below the grip 6 across in the front-back direction, and a hand pad, not shown, is attached to the hand belt 16. The hand belt 16 and hand pad support the hand of a user gripping the grip section 6 of the external case 12 and prevent the dropping of the imaging apparatus 1.

A microphone storage section 18 at the upper front of the external case 12 internally contains three microphones 101 to 103 each of which collect sound in stereo. The layout relationship among the microphones 101 to 103 will be described with reference to FIGS. 3A and 3B, which will be described later. A light emitting section 17 is placed at the upper front of the lens device 4 for emitting light during shooting in a dark place. An accessory such as a video light and an external microphone is removably attached to the top of the external case 12, and an accessory shoe, not shown, is provided therefor. The accessory shoe is placed above the lens device 4 and is normally covered removably by a shoe cap 5. An operating section 2 having multiple operation buttons is provided above the display section 3 stored in the external case 12.

Figure 2:
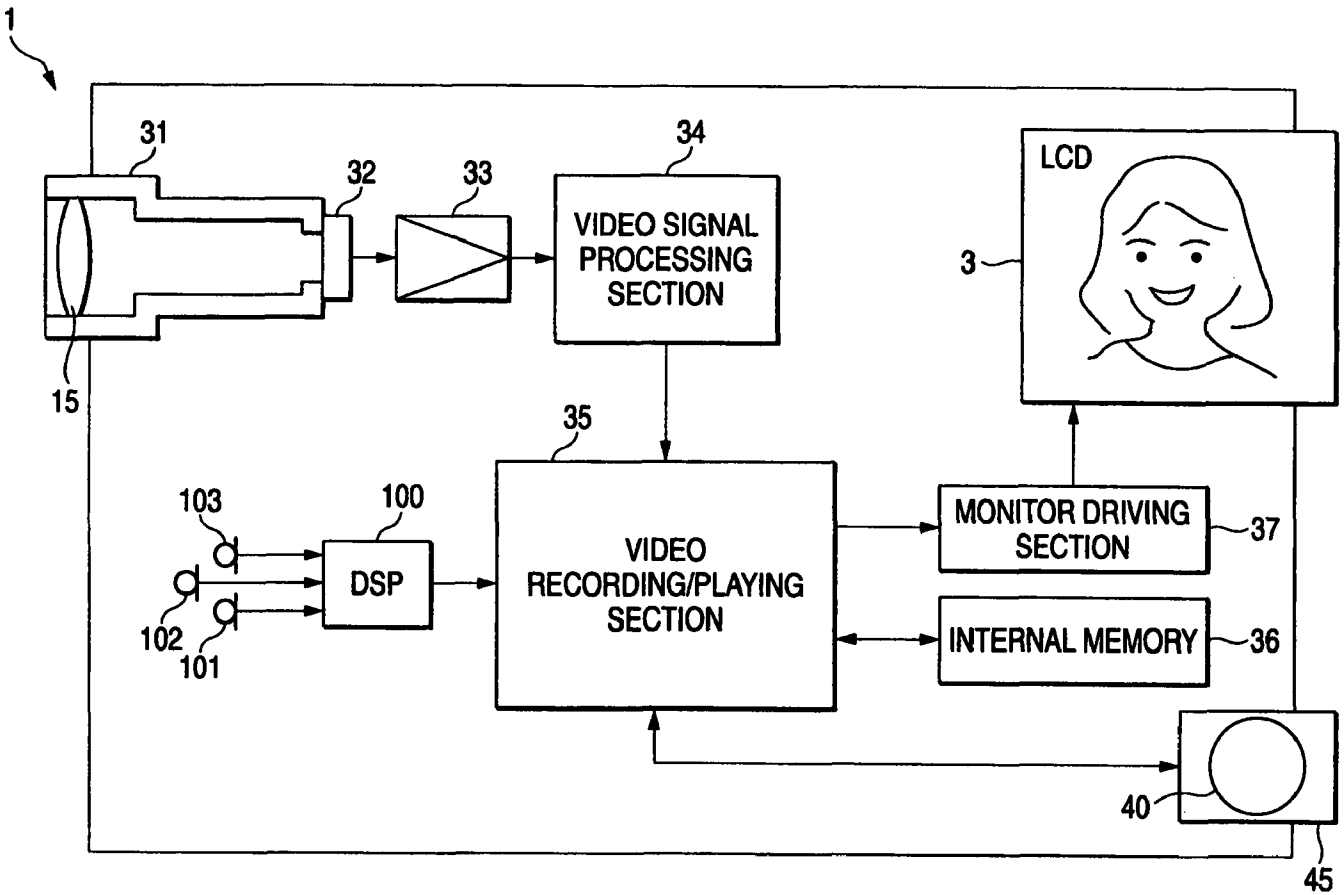
FIG. 2 is a block diagram showing an internal configuration example of the imaging apparatus according to the first embodiment of the invention.

Next, with reference to FIG. 2, an internal configuration example of the imaging apparatus 1 will be described. The imaging apparatus 1 includes, as a configuration for capturing a video signal, the lens barrel 31, the imaging device 32, an amplifier section 33 and a video signal processing section 34. The lens barrel 31 captures the image light of a shooting subject. The imaging device 32 converts the image light captured through the lens barrel 31 to a video signal. The amplifier section 33 amplifies the converted video signal. The video signal processing section 34 processes a shot video image, for example, to a predetermined signal. The imaging apparatus 1 further includes, as a configuration for capturing audio, the three microphones 101 to 103, an amplifier section, and a digital signal processor (DSP) 100. The amplifier section amplifies analog audio signals collected by the microphones 101 to 103. The DSP 100 is an audio signal processing circuit that converts an amplified analog audio signal to a digital signal and performs predetermined directivity synthesis processing.

The imaging apparatus 1 further includes a video recording/playing section 35, an internal memory 36, a display section 3, a monitor driving section 37 and an optical disk 40. The video recording/playing section 35 controls the recording and playing of a video signal supplied from the video signal processing section 34 and an audio signal supplied from the DSP 100. The internal memory 36 has a program memory for driving the video recording/playing section 35, a data memory and other RAM (random access memory) and ROM (read only memory). The display section 3 displays shot video, for example. The monitor driving section 37 drives the display section 3. The optical disk 40 records shot video and/or audio. The video recording/playing section 35 may include a computing circuit having a microcomputer (that is, CPU: central processing unit), for example.

After an image of a subject is input to the lens system of the lens barrel 31 and is formed on the image forming plane of the imaging device 32, the image signal generated by the imaging device 32 is input to the video signal processing section 34 through the amplifier section 33. The signal processed to a predetermined video signal by the video signal processing section 34 is input to the video recording/playing section 35. The signal corresponding to the image of the subject from the video recording/playing section 35 is output to the monitor driving section 37, the internal memory 36 or an optical disk driving section 45. As a result, the image corresponding to the image of the subject is displayed on the display section 3 through the monitor driving section 37. The image signal may be recorded in the internal memory 36 or the optical disk 40, as required.

Figure 3A:
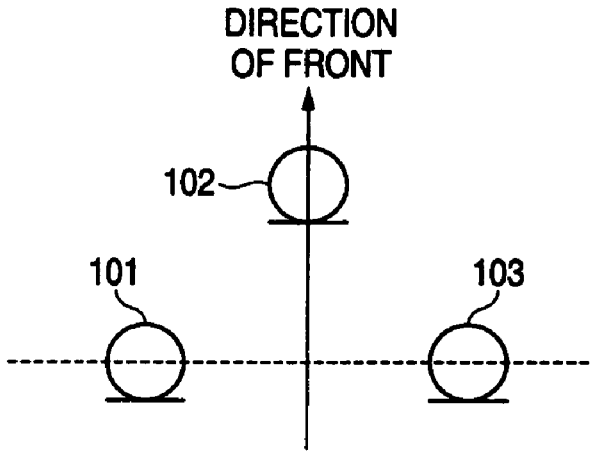
FIGS. 3A and 3B are explanatory diagrams showing examples of the layout of microphones according to the first embodiment of the invention.
Figure 3B:
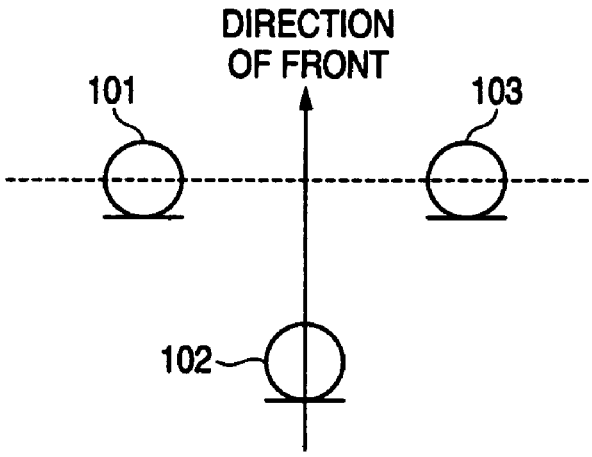

Next, with reference to FIGS. 3A and 3B, layout examples of omni-directional microphones for recording in surround sound will be described. The imaging apparatus 1 of this embodiment includes three microphones each of which can record in surround sound. As shown in FIG. 3A, the three microphones are laid out in a regular triangular form with the microphones 101 and 103 placed on a perpendicular straight line about the direction of the front and the microphone 102 placed in the direction of the front. Alternatively, as shown in FIG. 3B, the three microphones may be laid out in an inverted triangular form with the microphones 101 and 103 placed on the perpendicular straight line about the direction of the front and the microphone 102 placed on the opposite side of the direction of the front. However, the microphones 101 to 103 are not placed on one same straight line since an audio signal having a unidirectivity in the front-back direction only or right-left direction only can be generated if the microphones 101 to 103 are placed on one same straight line. It is also important that the distance between the microphones is sufficiently smaller, such as within several cm, than the wavelength of a sound wave at a lowest frequency of a necessary band.

Figure 4:
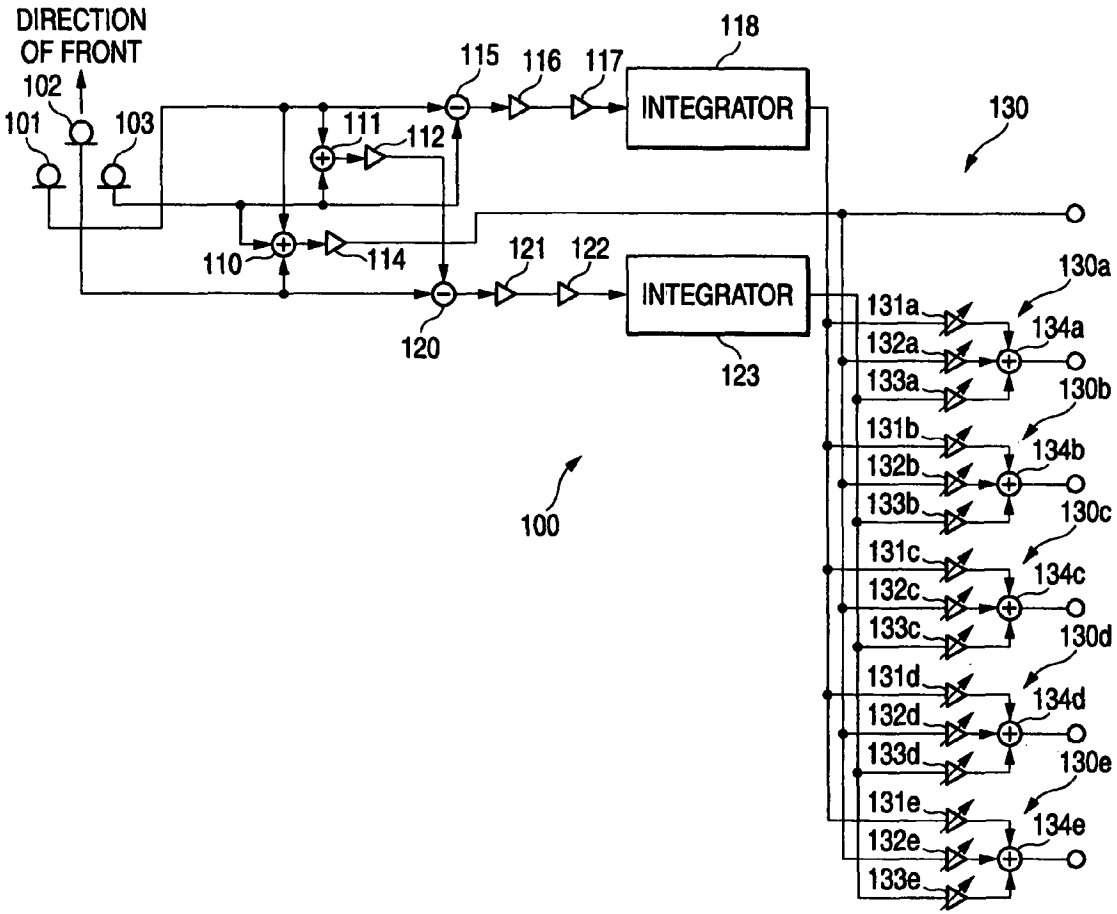
FIG. 4 is a block diagram showing an internal configuration example of a DSP according to the first embodiment of the invention.

Next, with reference to FIG. 4, an internal configuration example of the DSP 100 that performs directivity synthesis processing will be described. The DSP 100 includes a first adder section 110 and a second adder section 111, which add audio signals, a first subtractor section 115 and a second subtractor section 120, which subtract audio signals, multiplier sections 112, 114, 116, 117, 121, and 122, which multiply audio signals by a predetermined coefficient, and a first integrator section 118 and a second integrator section 123, which correct a frequency characteristic. The DSP 100 further includes variable gain amplifiers 131*a* to 131*e*, 132*a* to 132*e* and 133*a* to 133*e*, which variably amplify audio signals, and adder sections 134*a* to 134*e*, which add the variably amplified audio signals, for output sections 130*a* to 130*e* for the five channels in order to synthesize the unidirectivities of the five channels. The DSP 100 further includes an output section 130 for the 0.1 channel.

According to this embodiment, as a result of the addition of the variably amplified audio signals:

- the audio signal output by the output section 130*a* has a unidirectivity in the front center (FC) direction;
- the audio signal output by the output section 130*b* has a unidirectivity in the front left (FL) direction;
- the audio signal output by the output section 130*c* has a unidirectivity in the front right (FR) direction;
- the audio signal output by the output section 130*d* has a unidirectivity in the left surround (SL) direction at the rear left; and
- the audio signal output by the output section 130*e* has a unidirectivity in the right surround (SR) direction at the rear right.

The omni-directional microphones 101 to 103 placed in a regular triangular form about the direction of the front generate audio signals from received external audio. The audio signals generated by the microphones 101 to 103 undergo addition processing in the first adder section 110 and multiplication processing by a predetermined coefficient (such as ⅓) by the multiplier section 114, and an omni-directivity is thus synthesized. The audio signal generated by the omni-directional microphone 101 on the left about the direction of the front and the audio signal generated by the omni-directional microphone 103 on the right about the direction of the front undergo addition processing by the second adder section 111 and multiplication processing by a predetermined coefficient (such as ½) by the multiplier section 112, and a virtual omni-directivity positioned at the middle point between the microphone 101 and the microphone 103 is thus synthesized. The second subtractor section 120 obtains a difference between the audio signal output by the multiplier section 112 and an audio signal generated by the omni-directional microphone 102 in the direction of the front. The multiplier section 121 multiplies the difference by a coefficient for normalization, and bidirectivity in the front-back direction is synthesized.

Here, the sensitivity of the omni-directivity output by the multiplier section 114 is called "maximum directional sensitivity". The term "normalization" refers to the adjustment of the directional sensitivity of audio signals output from the other multiplier sections 116 and 121 with reference to the "maximum directional sensitivity". Since the normalization provides an equal maximum directional sensitivity among the audio signals output from the multiplier sections 114, 116 and 121, the synthesis can be performed more easily.

In the same manner, the first subtractor 115 obtains a difference between the audio signal generated by the omni-directional microphone 101 on the left side about the direction of the front and the audio signal generated by the omni-directional microphone 103 on the right side about the direction of the front. The multiplier section 116 multiples the difference by a coefficient, and normalizes the result with the maximum directional sensitivity, and bidirectivity in the right-left direction is synthesized. By multiplying the bidirectivity signal in the right-left direction and the bidirectivity signal in the front-back direction by a coefficient in the multiplier sections 117 and 122, the results are normalized with the omni-directivity of the output of the multiplier sections 114 and the maximum directional sensitivity. Since the output signals of the multiplier sections 117 and 122 are resulted from a difference between sound waves reaching the front and back and right and left microphones, signals of sound waves having a longer wavelength than the space between microphones, that is, signals at lower frequencies do not have a significant phase difference. For this reason, the frequency characteristics of the audio signals output by the multiplier sections 117 and 122 are attenuated as the frequency decreases.

Figure 5:
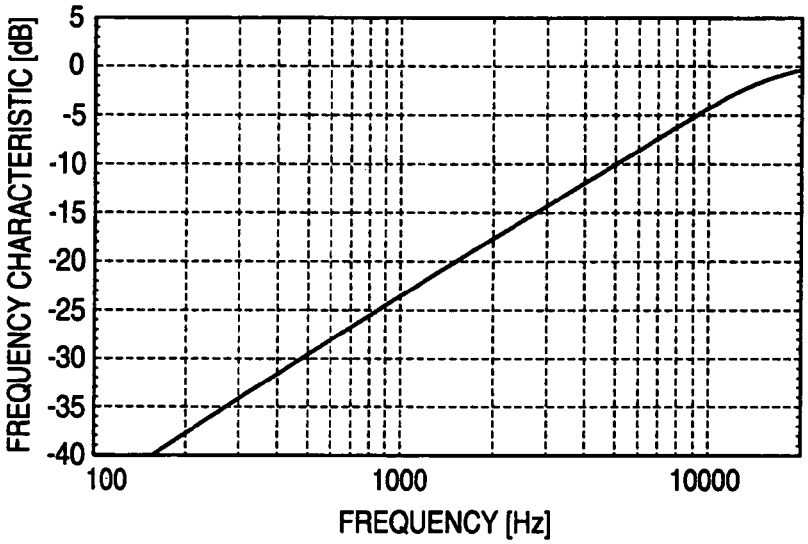
FIG. 5 is an explanatory diagram showing an example of the frequency characteristic of the output of a multiplier section according to the first embodiment of the invention.

With reference to FIG. 5, an example of the frequency characteristic of the audio signals output by the multiplier section 117 and the multiplier section 122 will be described. FIG. 5 shows that the more the frequency decreases, the less the output in the frequency characteristic is. In this case, the frequency characteristic may be regarded as a primary differentiation for convenience. Under this condition, low frequency components are not contained in the playbacked audio, and high frequency components are only playbacked. Then, in order to correct the frequency characteristic and raise the gain of the low frequencies, the audio signals output from the multiplier sections 117 and 122 are integrated by the first integrator section 118 and the second integrator section 123, respectively.

Figure 6A:
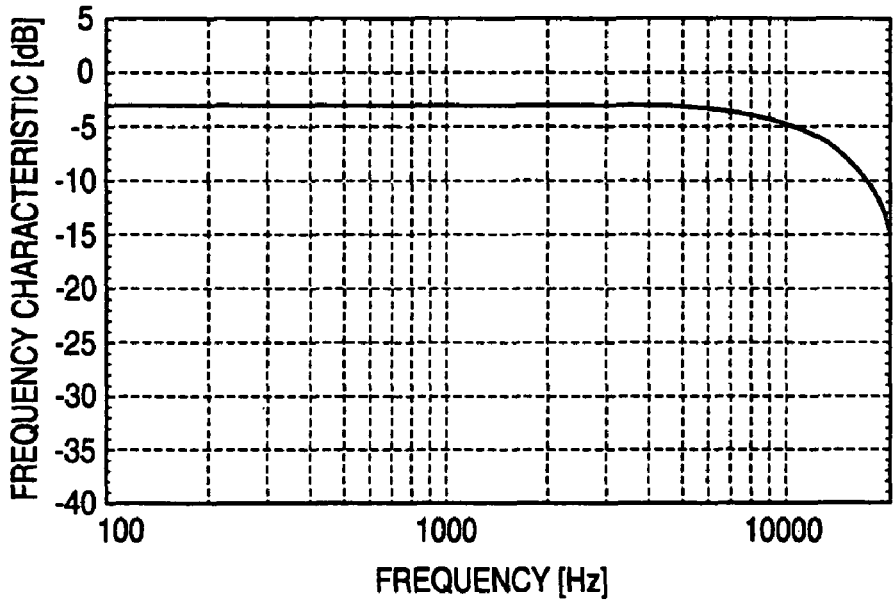
FIGS. 6A and 6B are explanatory diagrams showing examples of the frequency characteristic of the output of an integrator section having a directivity in the right-left direction according to the first embodiment of the invention.
Figure 6B:
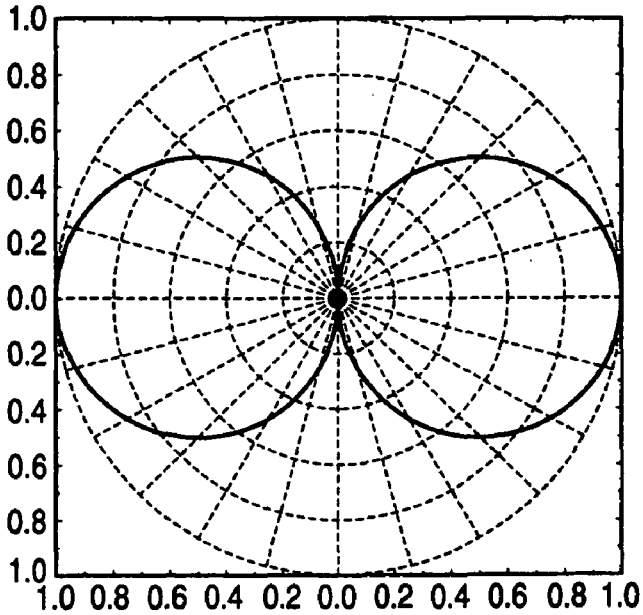

FIGS. 6A and 6B show examples of the frequency characteristic and directivity of the audio signal output by the first integrator section 118. FIG. 6A shows that the frequency band lower than 10000 Hz of the frequency characteristic of the audio signal is raised to a flat characteristic. FIG. 6B shows that the directivity of the audio signal in this case is the right-left direction.

Figure 7A:
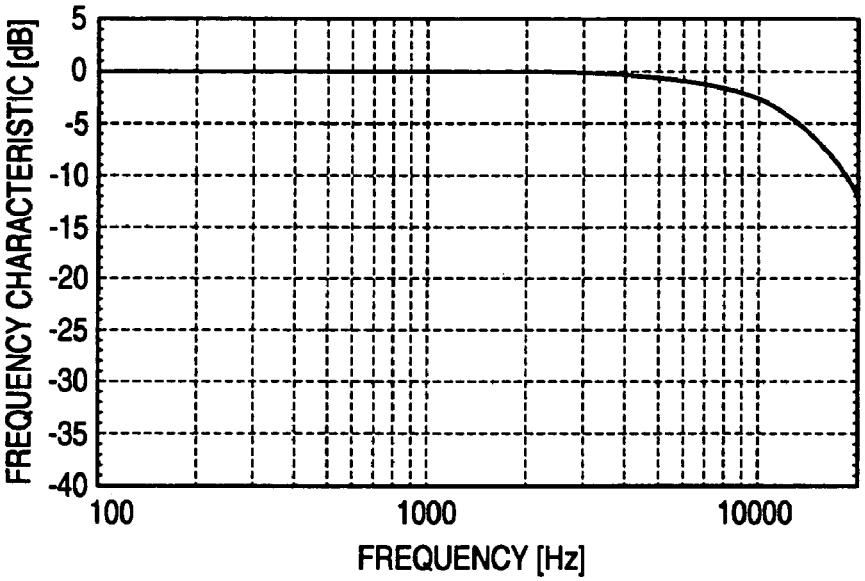
FIGS. 7A and 7B are explanatory diagrams showing examples of the frequency characteristic of the output of an integrator section having a directivity in the front-back direction according to the first embodiment of the invention.
Figure 7B:
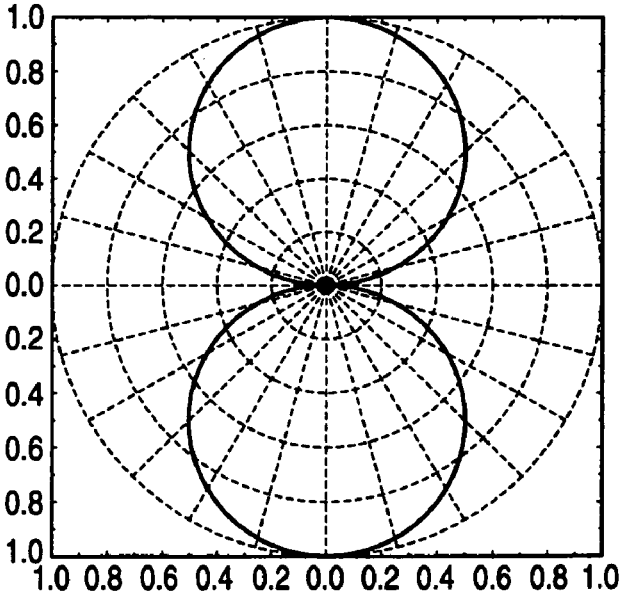

FIGS. 7A and 7B show examples of the frequency characteristic and directivity of the audio signal output by the second integrator section 123. FIG. 7A shows that the frequency band lower than 10000 Hz of the frequency characteristic of the audio signal is raised to a flat characteristic. FIG. 7B shows that the directivity of the audio signal in this case is the front-back direction.

Figure 8A:
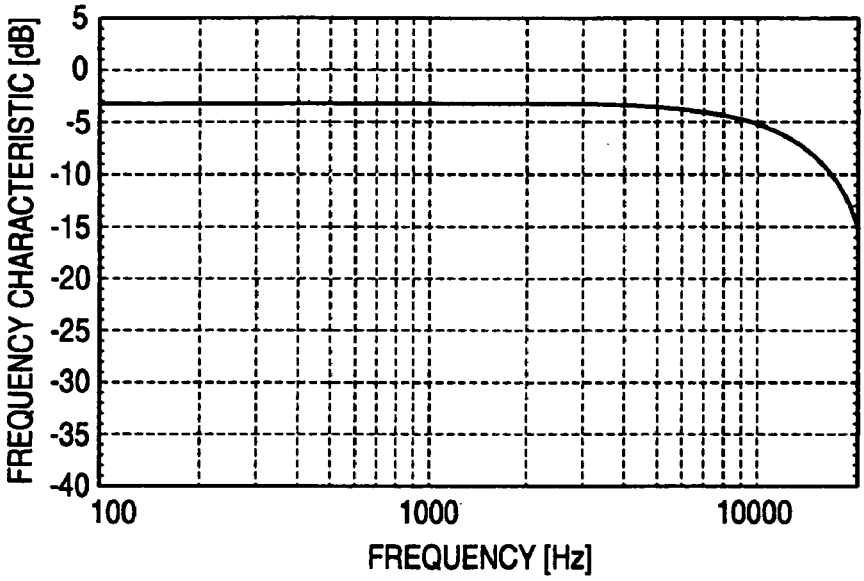
FIGS. 8A and 8B are explanatory diagrams showing examples of the frequency characteristic of the output of an adder section having a directivity in all directions according to the first embodiment of the invention.
Figure 8B:
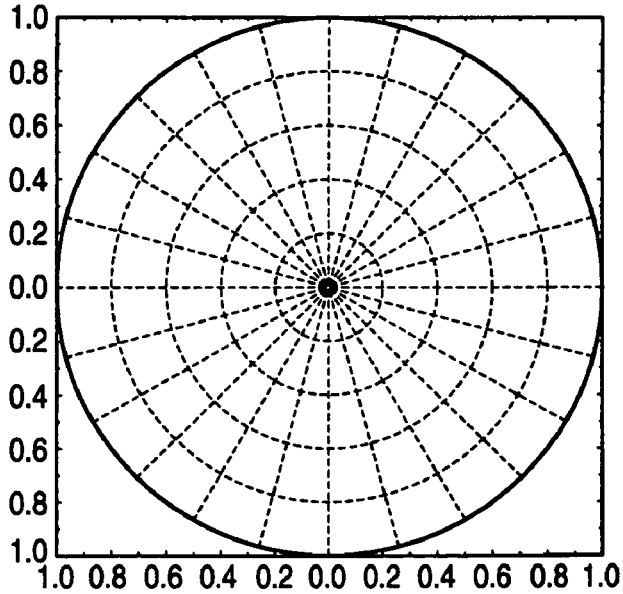
Figure 9A:
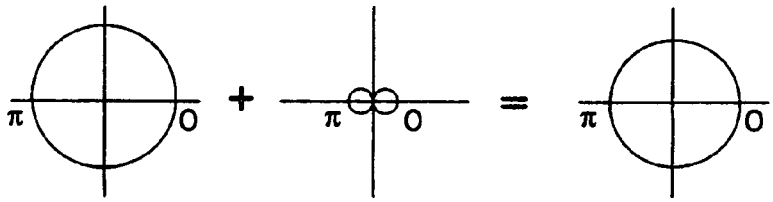
FIGS. 9A to 9E are explanatory diagrams showing examples of the processing of synthesizing unidirectional audio signals according to the first embodiment of the invention.
Figure 9B:
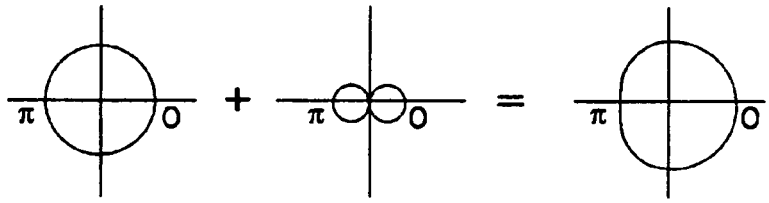
Figure 9C:
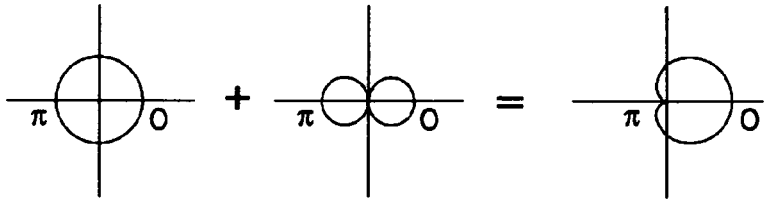
Figure 9D:
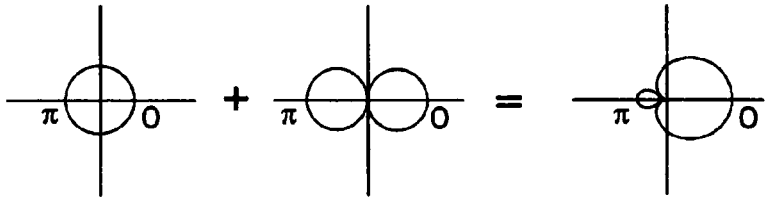
Figure 9E:
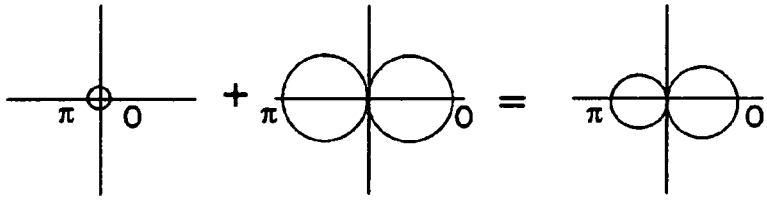

FIGS. 8A and 8B show examples of the frequency characteristic and directivity of the audio signal output by the multiplier section 114. FIG. 8A shows that the frequency band lower than 10000 Hz of the frequency characteristic of the audio signal is raised to a flat characteristic. FIG. 8B shows that the directivity of the audio signal in this case is all directions resulting from the addition of the right-left and front-back directions. The directivity of all directions is called the maximum directional sensitivity.

Using the three microphones 101 to 103 and correcting the frequencies allow the conversion to an audio signal having a directivity in all directions including the right-left and front-back directions. The audio signals output by the first integrator section 118 and the second integrator section 123 contain a bidirectional component in the right-left direction and a bidirectional component in the front-back direction, which are normalized with the maximum directional sensitivity. An audio signal having a unidirectivity can be synthesized by changing the synthesis ratio among the omni-directional component of the audio signal output by the multiplier 114, the bidirectional component in the right-left direction and the bidirectional component in the front-back direction. The patterns of directivities which are synthesized can be a cardioid curve, a hyper-cardioid curve and a super-cardioid curve, for example.

With reference to FIGS. 9A to 9E, examples of the processing of synthesizing a unidirectional audio signal will be described. FIGS. 9A to 9E show examples of directivities of output audio signals in a case where the two input audio signals indicated by a polar coordinates system are synthesized. The left audio signals of the plurality of two input audio signals have omni-directional components, and the right audio signals have bidirectional components in the right-left direction. The sensitivities of the audio signals are indicated by circles.

The audio signals at 0 to 90 degrees and 270 to 360 degrees are handled as positive phase components. The addition of the positive phase components of the two audio signals is exhibited as an increased positive phase component. On the other hand, the audio signal at 90 to 270 degrees is handled as a negative phase component. The addition of the negative phase components of two audio signals is exhibited as a decreased negative phase component. This means that an audio signal having an arbitrary unidirectivity in the right-left direction can be created by allowing the sensitivities for the omni-directional component and the bidirectional component to be adjusted and adding them. Having described the example in which the two input audio signals are synthesized with reference to FIGS. 9A to 9E, an audio signal having a unidirectivity in an arbitrary direction can be generated by synthesizing audio signals having a bidirectional component in the front-back direction.

Here, in an example relating to the output section 130*a*, an arbitrary direction and/or an arbitrary sub lobe can be defined by changing the coefficient rate when changing the synthesis ratio between the omni-directivity and the bidirectivity through the coefficient multiplication by the variable gain amplifiers 131*a*, 132*a* and 133*a* and the addition by the adder section 134*a* to synthesize a unidirectivity. By changing the synthesis ratio among the variable gain amplifiers 131*a*, 132*a* and 133*a*, the form of the cardioid curve can be changed, and the sensitivity for a directivity characteristic can also be changed.

Figure 10:
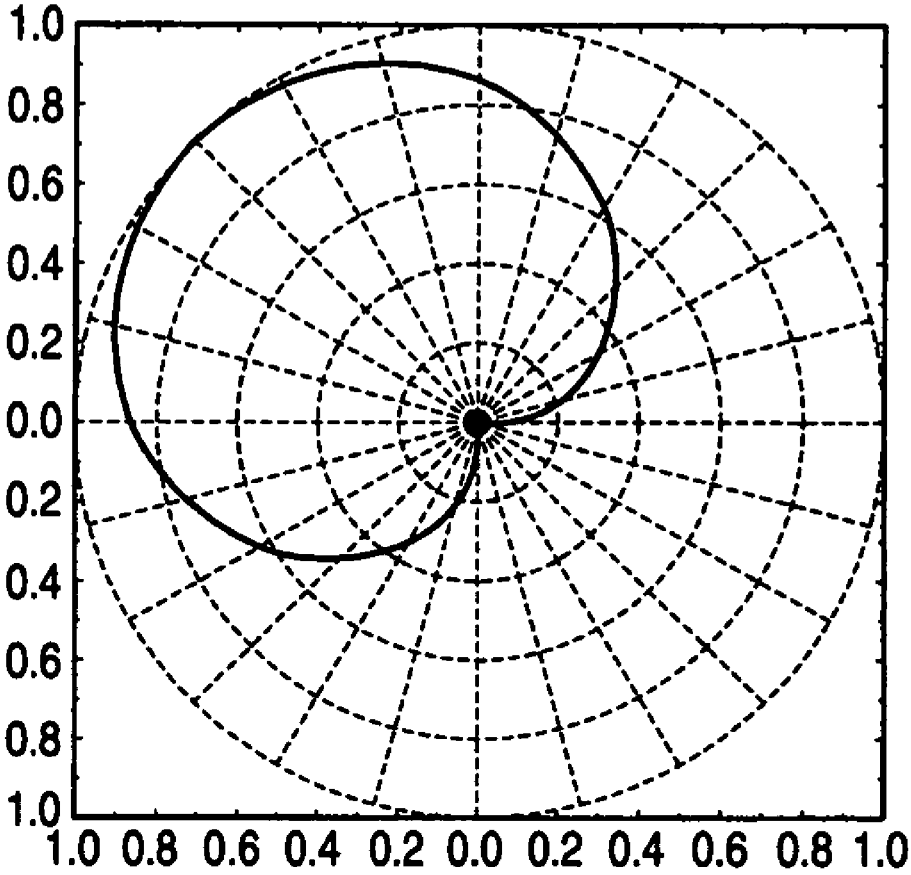
FIG. 10 is an explanatory diagram showing an example of the cardioid curve according to the first embodiment of the invention.

FIG. 10 shows an example of the directivity characteristic of the audio signal with a changed synthesis ratio among the variable gain amplifiers 131*a*, 132*a* and 133*a*. The directivity characteristic of the audio signal output by the output section 130*a* exhibits a cardioid curve, which means a unidirectivity in the direction of 135 degrees about the right side as 0 degree.

Figure 11:
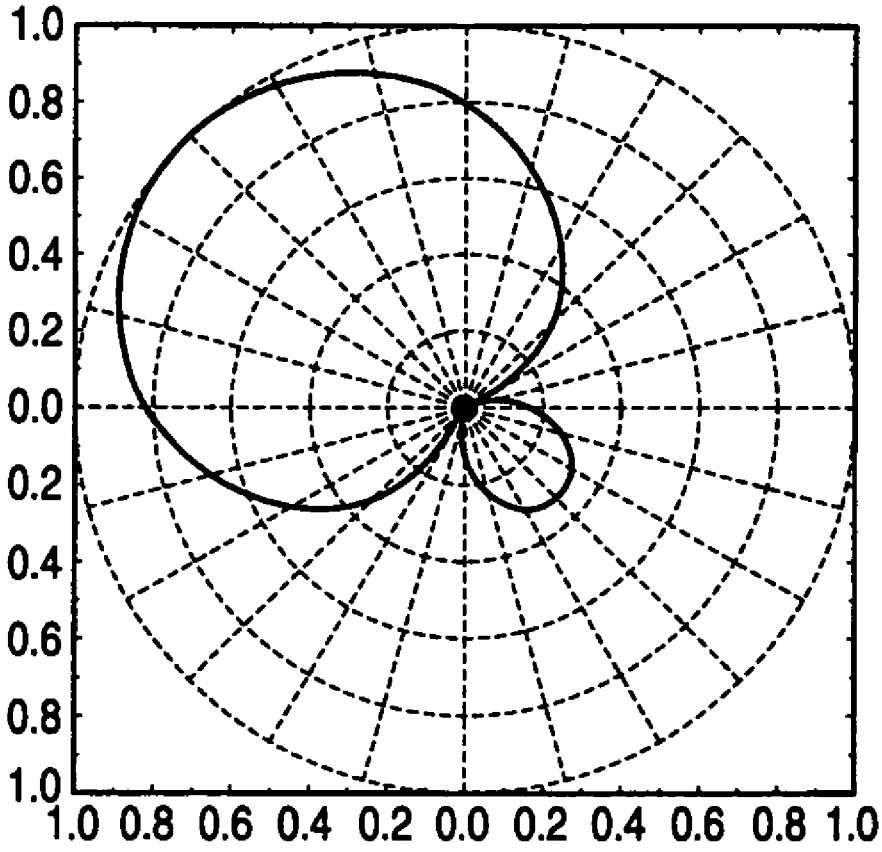
FIG. 11 is an explanatory diagram showing an example of the hyper-cardioid curve according to the first embodiment of the invention.

Similarly, FIG. 11 shows an example of the directivity characteristic of the audio signal with a changed synthesis ratio among the variable gain amplifiers 131*a*, 132*a* and 133*a*. The directivity characteristic of the audio signal output by the output section 130*a* exhibits a hyper-cardioid curve, which means a unidirectivity in the direction of 135 degrees about the right side as 0 degree.

As shown in FIGS. 10 and 11, changing the synthesis ratio among the variable gain amplifiers 131*a*, 132*a* and 133*a* can change the directivity characteristic. Furthermore, providing the five output sections 130*a* to 130*e* allows the synthesis of unidirectional audio signals of five channels.

For example, like this embodiment, the 5.1 channel recording in surround sound can be implemented by synthesizing the unidirectional audio signals of five channels and handing an audio signal of 0.1 channel of an omni-directional component output by the output section 130 (multiplier section 114) as an audio signal of an LFE (Low Frequency Effect) channels. The LFE channel is an audio signal especially for low frequencies to be output by a sub-woofer.

FIGS. 12A to 16B show frequency characteristics of audio signals output by the adder sections 134*a* to 134*e* according to this embodiment and examples of the directivities of the channels.

Figure 12A:
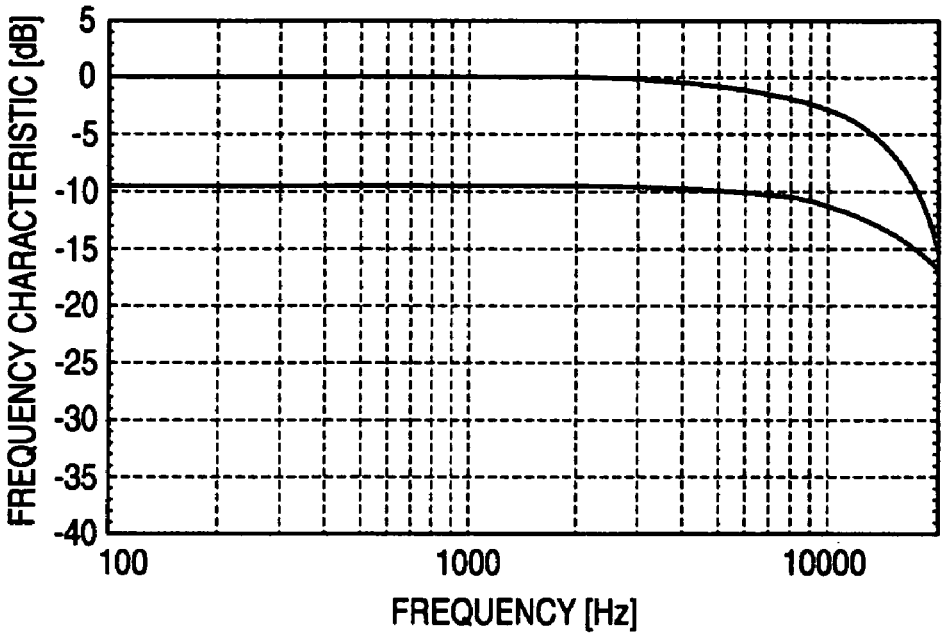
FIGS. 12A and 12B are explanatory diagrams showing examples of the frequency characteristic of an output section having a directivity in the front center (FC) direction according to the first embodiment of the invention.
Figure 12B:
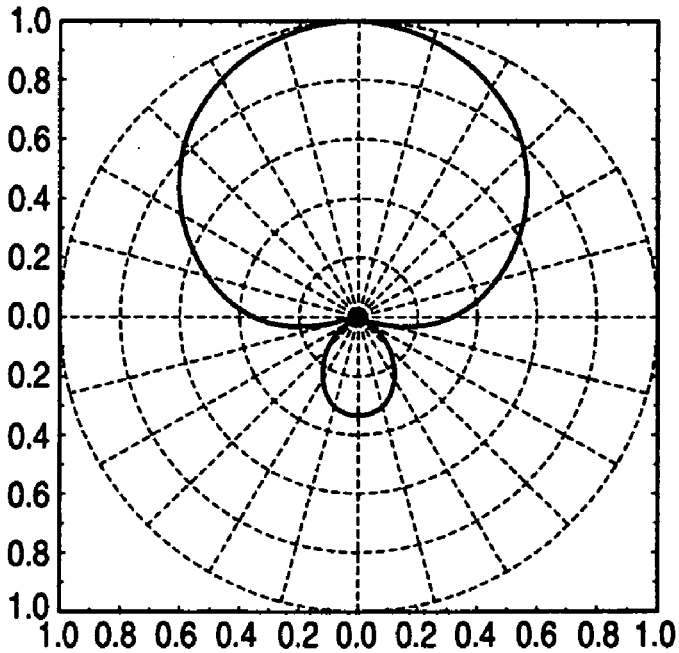

FIGS. 12A and 12B show examples of the frequency characteristic and directivity of an audio signal output by the adder section 134*a*. FIG. 12A shows that the frequency band lower than 10000 Hz of the frequency characteristic of the audio signal is raised to a flat characteristic. FIG. 12B shows that the directivity pattern of the audio signal is a hyper-cardioid curve and has a unidirectivity in the front center (FC) direction.

Figure 13A:
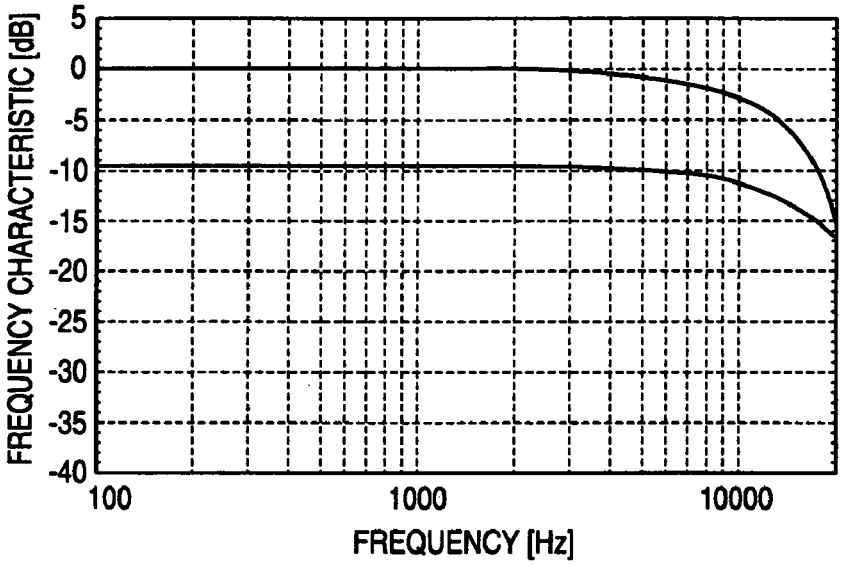
FIGS. 13A and 13B are explanatory diagrams showing examples of the frequency characteristic of an output section having a directivity in the front left (FL) direction according to the first embodiment of the invention.
Figure 13B:
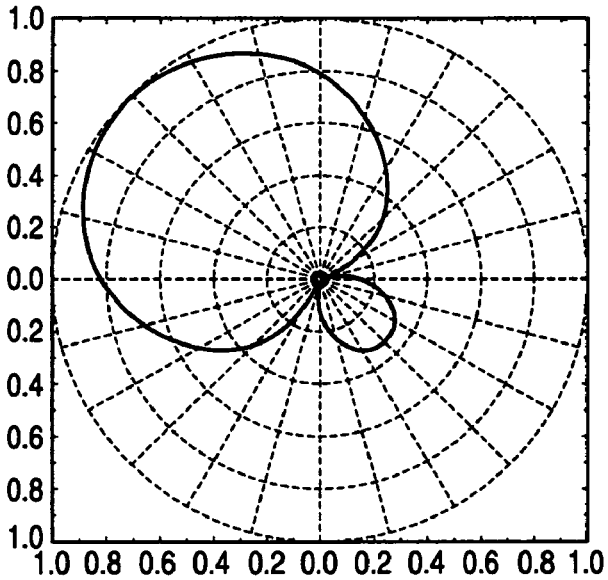

FIGS. 13A and 13B show examples of the frequency characteristic and directivity of an audio signal output by the adder section 134*b*. FIG. 13A shows that the frequency band lower than 10000 Hz of the frequency characteristic of the audio signal is raised to a flat characteristic. FIG. 13B shows that the directivity pattern of the audio signal is a hyper-cardioid curve and has a unidirectivity in the front left (FL) direction.

Figure 14A:
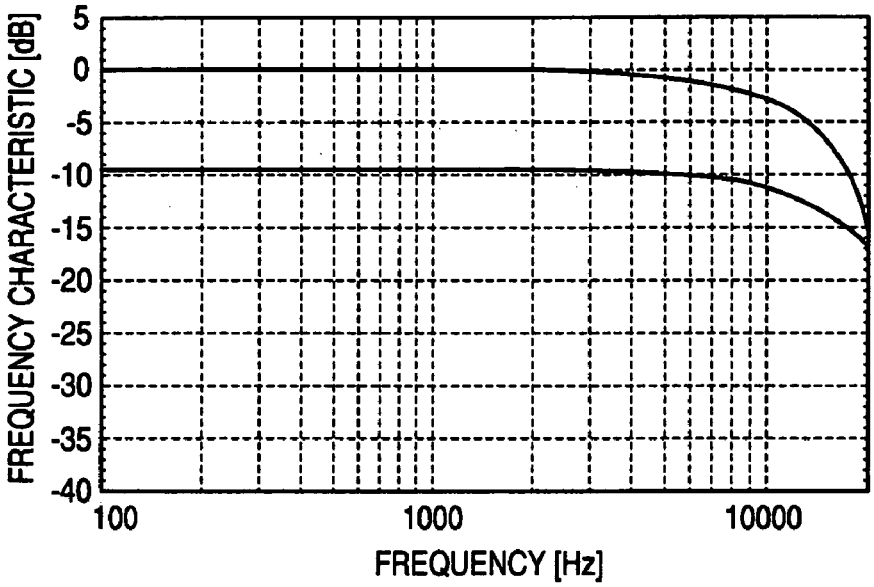
FIGS. 14A and 14B are explanatory diagrams showing examples of the frequency characteristic of an output section having a directivity in the front right (FR) direction according to the first embodiment of the invention.
Figure 14B:
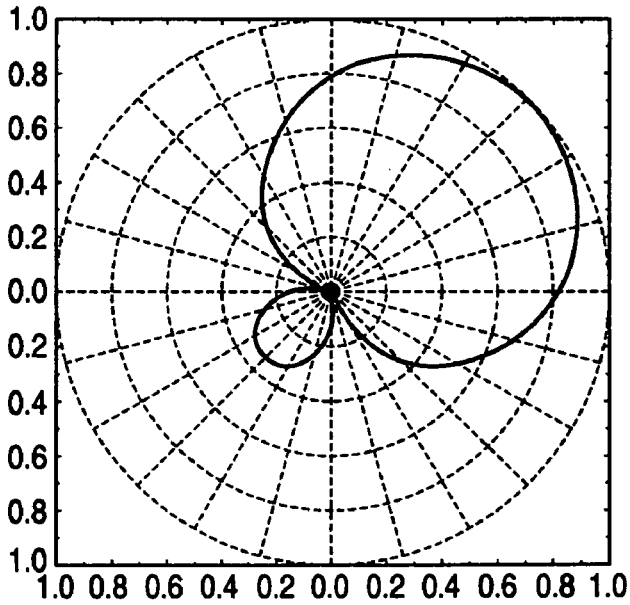

FIGS. 14A and 14B show examples of the frequency characteristic and directivity of an audio signal output by the adder section 134*c*. FIG. 14A shows that the frequency band lower than 10000 Hz of the frequency characteristic of the audio signal is raised to a flat characteristic. FIG. 14B shows that the directivity pattern of the audio signal is a hyper-cardioid curve and has a unidirectivity in the front right (FR) direction.

Figure 15A:
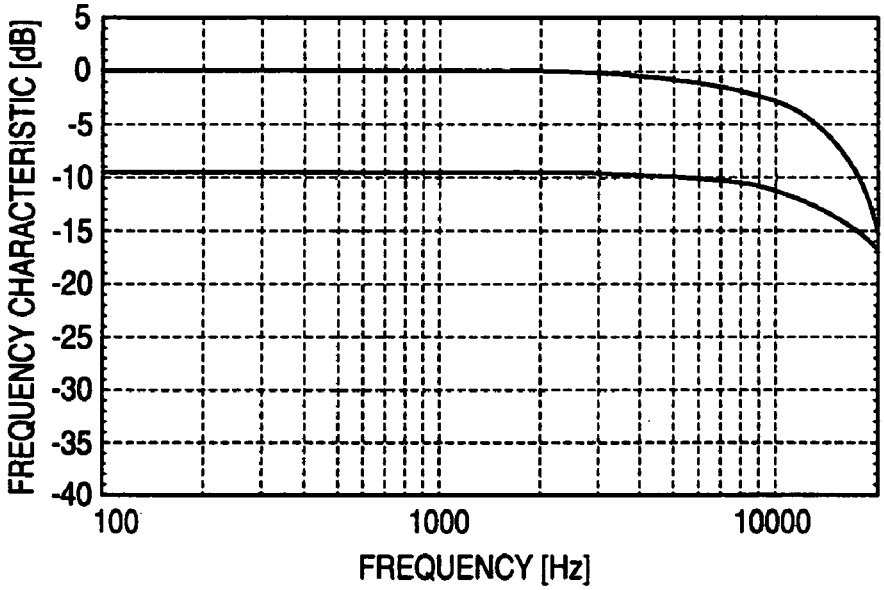
FIGS. 15A and 15B are explanatory diagrams showing examples of the frequency characteristic of an output section having a directivity in the Surround Left (SL) direction at the rear left according to the first embodiment of the invention.
Figure 15B:
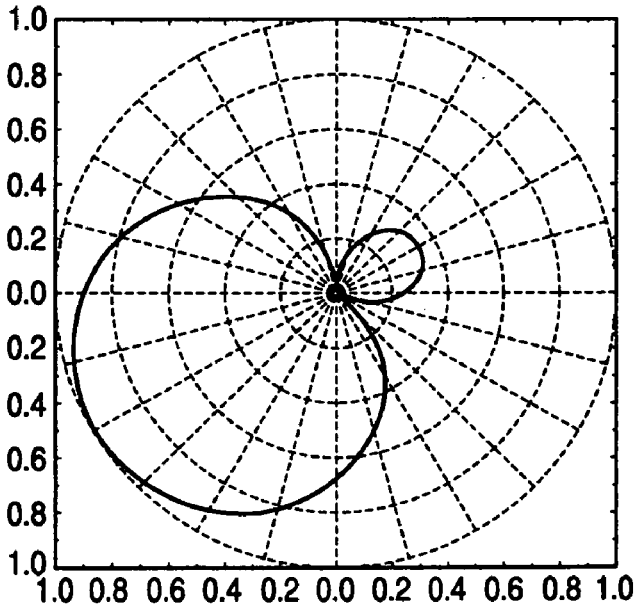

FIGS. 15A and 15B show examples of the frequency characteristic and directivity of an audio signal output by the adder section 134*d*. FIG. 15A shows that the frequency band lower than 10000 Hz of the frequency characteristic of the audio signal is raised to a flat characteristic. FIG. 15B shows that the directivity pattern of the audio signal is a hyper-cardioid curve and has a unidirectivity in the surround left (SL) direction at the rear left.

Figure 16A:
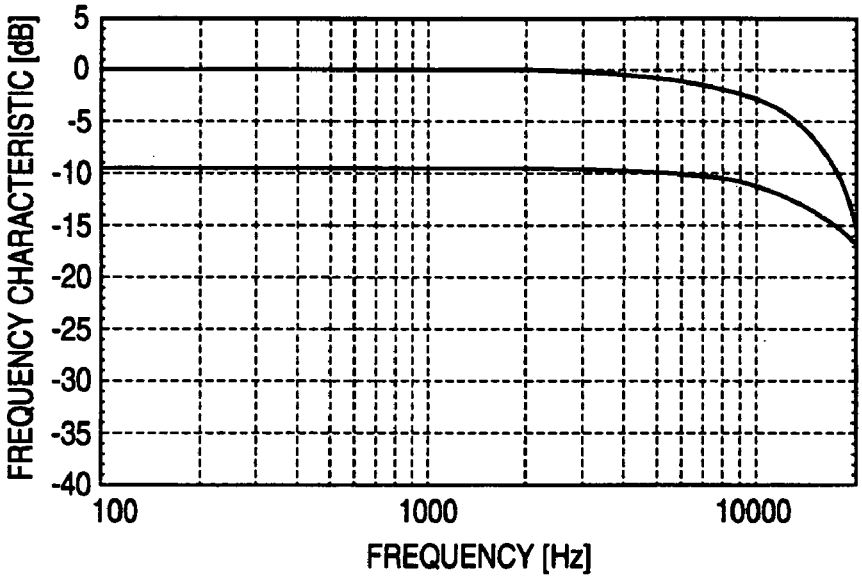
FIGS. 16A and 16B are explanatory diagrams showing examples of the frequency characteristic of an output section having a directivity in the Surround Right (SR) direction at the rear right according to the first embodiment of the invention.
Figure 16B:
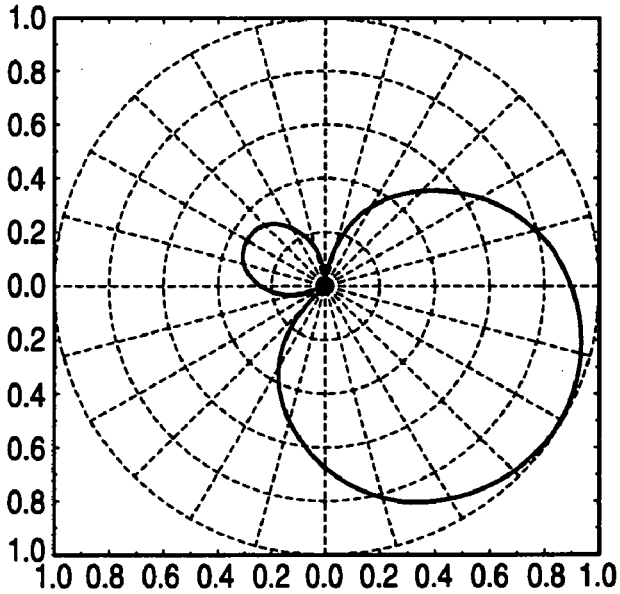

FIGS. 16A and 16B show examples of the frequency characteristic and directivity of an audio signal output by the adder section 134*e*. FIG. 16A shows that the frequency band lower than 10000 Hz of the frequency characteristic of the audio signal is raised to a flat characteristic. FIG. 16B shows that the directivity pattern of the audio signal is a hyper-cardioid curve and has a unidirectivity in the surround right (SR) direction at the rear right.

According to the first embodiment described above, using only the three microphones 101 to 103 allows generation and recording of an audio signal having a desired directivity pattern. Each of the microphones is an omni-directional microphone. The three omni-directional microphones 101 to 103 are spaced apart by a distance sufficiently smaller than the wavelength of a sound wave and are laid out in a triangular form. The layout allows the synthesis of the directivities of audio signals in an arbitrary direction through computing processing.

According to this embodiment, the addition and subtraction of audio signals collected by three omni-directional microphones generates an audio signal having an omni-directivity in the whole circumferential direction, an audio signal having a bidirectivity in the right-left direction, and an audio signal having a bidirectivity in the front-back direction. A unidirectional audio signal is synthesized by multiplying these audio signals by a predetermined coefficient and adding the results, and the recording in surround sound for multiple channels can be implemented. An omni-directional microphone is inexpensive, and three microphones are enough, though the number of microphones is equal to the number of channels to be recorded in the past, which can advantageously contribute to the reduction of the entire costs.

The direction of the maximum directional sensitivity for a unidirectivity can be defined in an arbitrary direction. The sensitivity for the directivity of a collected audio signal can be freely changed. For example, a cardioid curve can be changed to a hyper-cardioid or super-cardioid curve. Thus, a unidirectivity of multiple channels in an arbitrary direction and in an arbitrary form can be synthesized by providing the output sections having similar components to the coefficient multiplier section and adder section included in the output section 130*a*. In this case, the number of output sections is equal to the number of desired channels. Therefore, the number of parts can be reduced, and the costs can be advantageously reduced.

The directional sensitivities of an audio signal having bidirectivities in the right-left and front-back directions are adjusted in accordance with the maximum directional sensitivity of an audio signal having an omni-directivity. Therefore, an audio signal with energy averaged among three microphones can be recorded so that the level of an audio signal to be recorded becomes unnecessarily low or high.

The first integrator section 118 and the second integrator section 123 are placed after the first subtractor section 115 and the second subtractor section 120, respectively. Thus, even when the low frequency band falls down to a degree that the audio signal is regarded as a primary differentiation by the subtractor sections, the low frequency band of the frequency characteristic can be raised to a flat characteristic by the integrator sections. As a result, the audio signal of the low frequency band even can be advantageously recorded.

Figure 17:
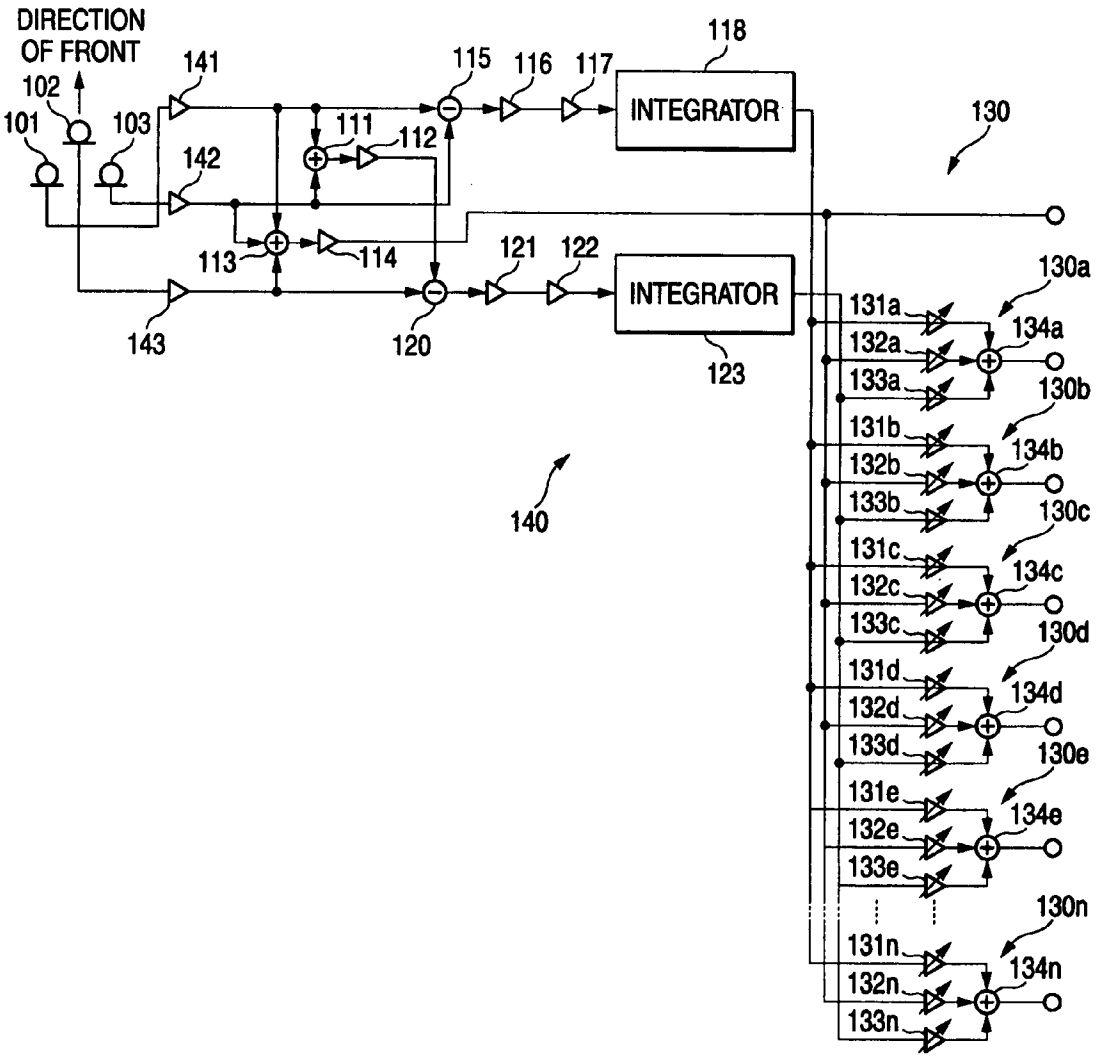
FIG. 17 is a block diagram showing an internal configuration example of a DSP according to a second embodiment of the invention.

Next, with reference to FIG. 17, an internal configuration example of a DSP supporting multi-channels for recording in surround sound will be described as a second embodiment of the invention. This embodiment is also described based on an example in which the invention is applied to an imaging apparatus that records audio in surround sound. The same reference numerals are given to the parts in FIG. 17 corresponding to those in FIG. 4, which have been already described, and the detail descriptions thereon will be omitted herein.

A DSP 140 according to this embodiment includes preamplifiers 141 to 143, which amplify audio signals generated by the three microphones 101 to 103. It is generally known that the microphones 101 to 103 have variations in sensitivity according to mount locations etc. For this reason, it is difficult to obtain a desired unidirectivity due to the variations in sensitivity among omni-directional microphones. Then, in order to suppress the variations in sensitivity of the microphones, the preamplifiers 141 to 143 correct the variations in sensitivity among the microphones 101 to 103 in advance. The preamplifiers 141 to 143 are provided for the microphones 101 to 103, respectively, and have functions of correcting variations in sensitivity by multiplying audio signals by a correction coefficient.

The DSP 140 according to this embodiment has more output sections 130*n* than five channels, and 100 output sections may be provided, for example. Here, the output section 130*n* includes variable gain amplifiers 131*n*, 132*n* and 133*n* that variably amplify audio signals and adder section 134*n* that add the variably amplified audio signals, like the output sections 130*a* to 130*e* for five channels.

Since the DSP 140 according to this embodiment having described above includes the preamplifiers 141 to 143, a variation in sensitivity among the microphones 101 to 103 can be corrected. Since the audio signals corrected for variations in sensitivity are generated in advance, the subsequent addition, multiplication and subtraction processing, for example, can be performed without consideration of the variation in sensitivity, so that the processing can be advantageously simplified.

Since more (such as 100) output sections 130*n* than five channels are provided, more output sections for audio signals than five channels can be provided. Therefore, audio can be advantageously recorded in surround sound with a desired number of channels.

Figure 18:
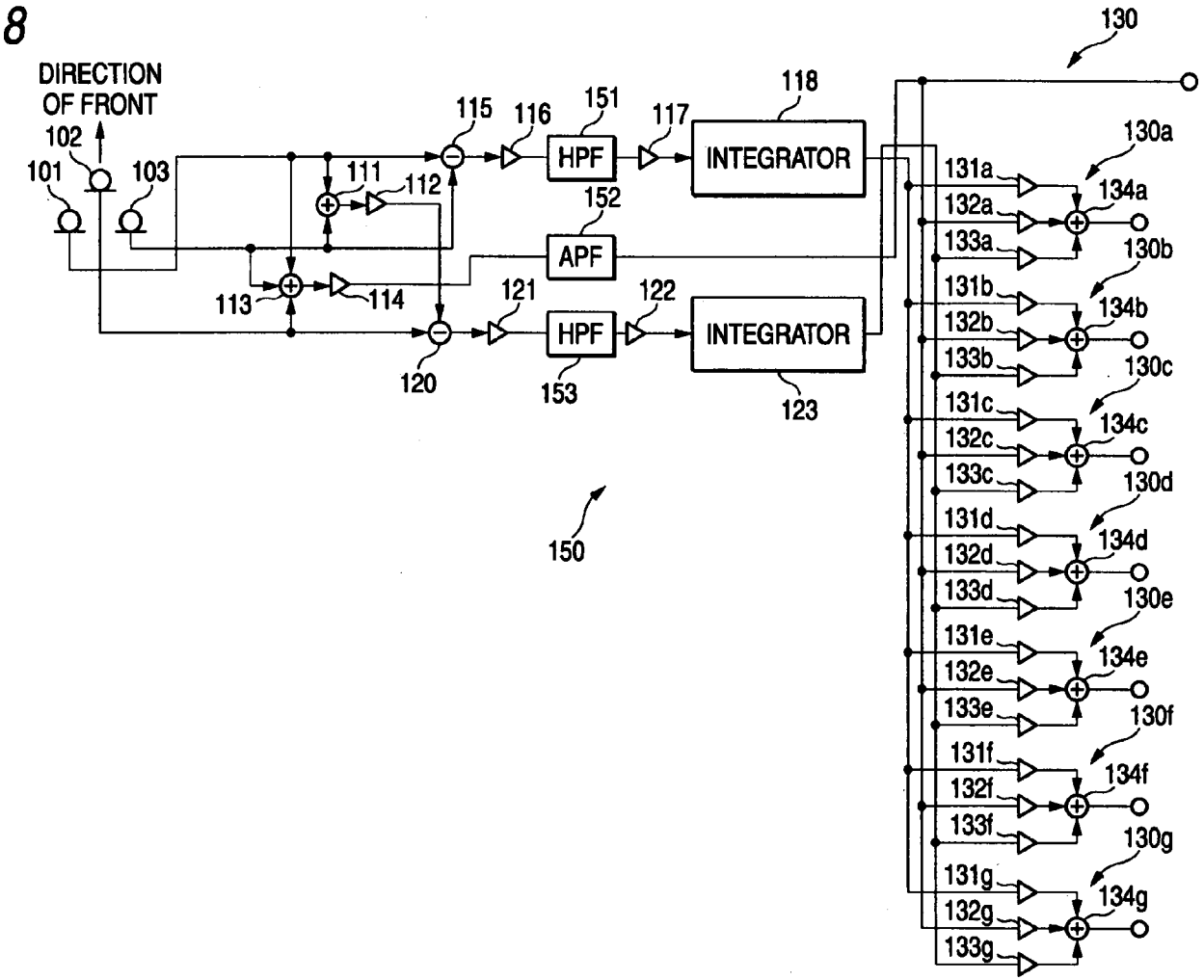
FIG. 18 is a block diagram showing an internal configuration example of a DSP according to a third embodiment of the invention.

Next, with reference to FIGS. 18 and 19, an internal configuration example of a DSP 150, which reduces wind noise to decrease the deterioration of a frequency characteristics and directivities, will be described as a third embodiment of the invention. This embodiment is also described based on an example in which the invention is applied to an imaging apparatus that records audio in surround sound. The same reference numerals are given to the parts in FIG. 18 corresponding to those in FIGS. 4 and 17, which have been already described, and the detail descriptions thereon will be omitted herein.

Along with the recent increase in number of channels for recording in surround sound, even for multi-channel, such as 7.1 channels, recording with seven output sections similar to the output section 130*a* can be provided to implement the 7.1 channel surround sound recording. The 7.1 channel surround sound refers to a playing method with speakers placed at the front, fronts right and left, right and left, and rears right and left and can be arbitrarily defined according to the invention.

In order to do so, bidirectional lower frequencies are cut by high pass filters (HPF) 151 and 153, which only allow a high frequency component to pass through. In this case, since the bidirectional low frequencies only differ in phase characteristic, an all pass filter (APF) 152, which advances the phase of a passing audio signal, is inserted after the multiplier section 114. Then, the bidirectional frequencies and the omni-directional frequencies are brought into phase by the APF 152 beforehand. According to this embodiment, low frequency sound is not lost even when wind noise and low frequency sound are mixed since the bidirectional low frequencies only are cut.

The DSP 150 according to this embodiment further includes output sections 130*f* and 130*g* for two channels in addition to the output sections 130*a* to 130*e* for five channels. The output section 130*f* includes variable gain amplifiers 131*f*, 132*f* and 133*f*, which variably amplify audio signals, and an adder section 134*f*, which adds the variably amplified audio signals. Similarly, the output section 130*g* includes variable gain amplifiers 131*g*, 132*g* and 133*g*, which variably amplify audio signals, and an adder section 134*g*, which adds the variably amplified audio signals.

Figure 19:
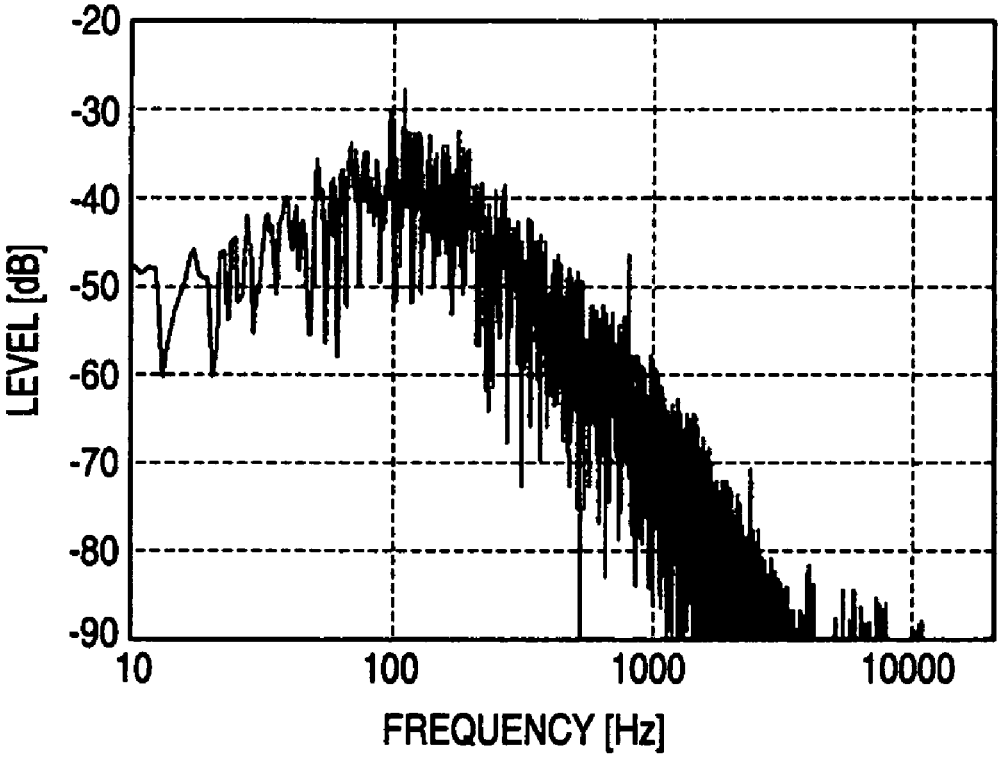
FIG. 19 is a diagram showing an example of the frequency characteristic of wind noise according to an embodiment of the invention.

With reference to FIG. 19, an example of the frequency characteristic of wind noise will be described. FIG. 19 shows that the concentration of noise energy of wind noise is on low frequencies (such as 1000 Hz and lower). In consideration of the relationship between bidirectional gain and omni-directional gain, the bidirectional gain is significantly higher. Therefore, since the influential term of the noise level is the bidirectional frequencies, the bidirectional low frequency component only is cut by the HPFs 151 and 153.

Since the DSP 150 according to this embodiment having described above includes the high-pass filters 151 and 153, the low frequency component of the audio signal included in wind noise can be efficiently cut. The audio signals having passed through the high-pass filters 151 and 153 are received by the three microphones 101 to 103, and the phases of the added audio signals are corrected by the all-pass filter 152. Therefore, with the matched phase, the omni-directional component, the bidirectional component in the right-left direction and the bidirectional component in the front-back direction of an audio signal can be adjusted, added, and output to the channels. Since the omni-directional component, bidirectional component in the right-left direction and the bidirectional component in the front-back direction of an audio signal can be added with reduced wind noise, unnecessary wind noise is not mixed into the added audio signal, which means that clear audio signals can be advantageously recorded.

Furthermore, surround 7.1 channel recording can be performed by seven output sections, which output audio signals, with only three microphones provided for receiving external audio. Therefore, the costs can be advantageously reduced for performing the recording in surround sound.

Figure 20:
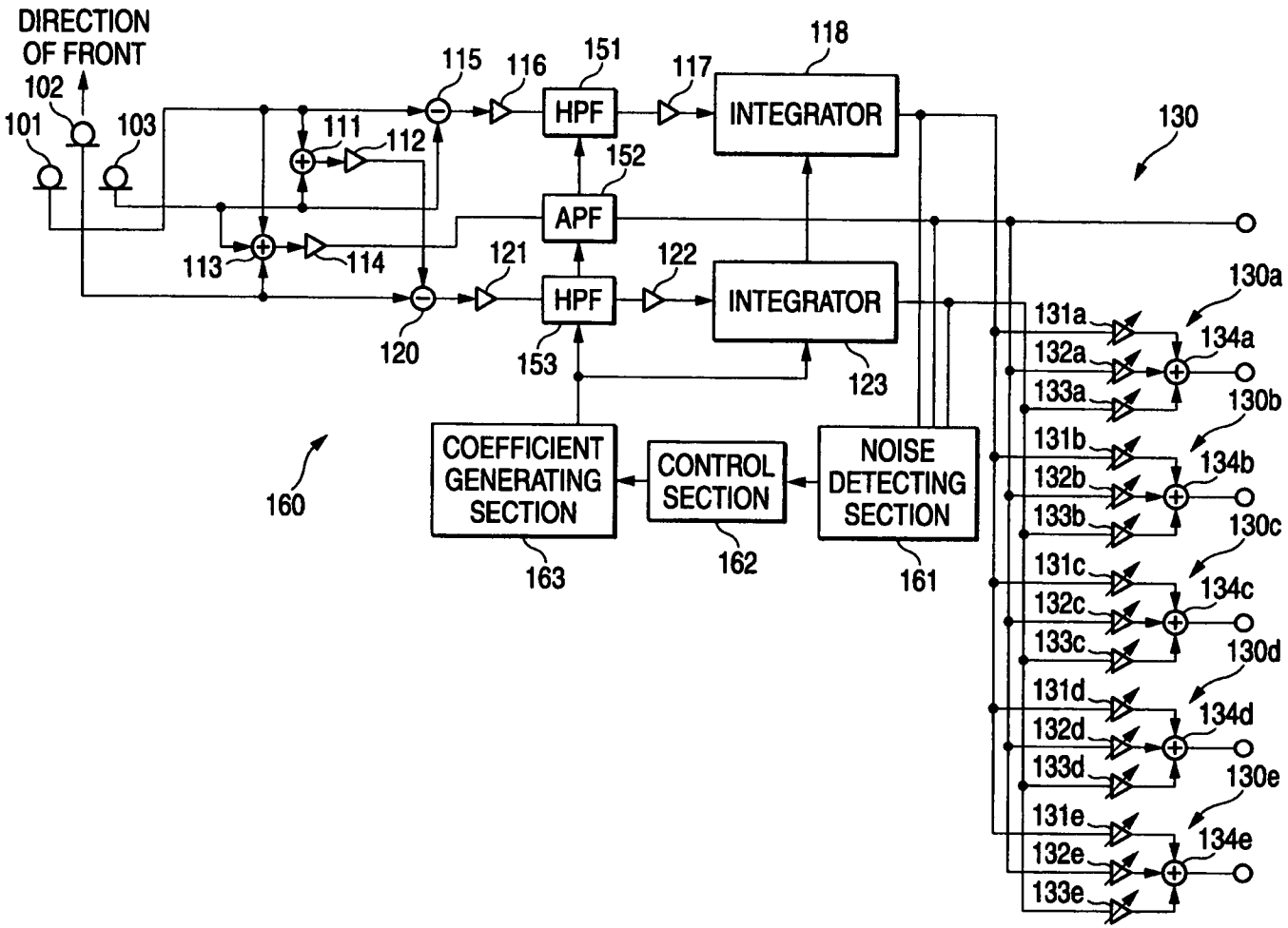
FIG. 20 is a block diagram showing an internal configuration example of a DSP according to a fourth embodiment of the invention.

Next, with reference to FIG. 20, an internal configuration example of a DSP 160 dynamically cutting a low frequency component of an audio signal will be described as a fourth embodiment of the invention. This embodiment is also described based on an example in which the invention is applied to an imaging apparatus that records audio in surround sound. The same reference numerals are given to the parts in FIG. 20 corresponding to those in FIGS. 4 and 18, which have been already described, and the detail descriptions thereon will be omitted herein.

The DSP 160 according to this embodiment controls to dynamically cut a low frequency component of an audio signal by using a feedback loop. The audio signals output from the first integrator section 118, second integrator section 123 and all-pass filter 152 are supplied to a noise detecting section 161, which detects wind noise. The noise detecting section 161 detects wind noise from an input audio signal and supplies information on the detected wind noise to a control section 162, which controls a feedback loop. The control section 162 calculates a coefficient for cutting wind noise based on the supplied wind noise information and notifies the coefficient to a coefficient creating section 163, which creates a predetermined cutoff coefficient and integration coefficient.

The coefficient creating section 163, which creates a coefficient, creates a cutoff coefficient for the HPFs 151 and 153 and a cutoff coefficient for the APF 152 based on the coefficient notified by the control section 162. The created cutoff coefficients are supplied to the HPFs 151 and 153 and the APF 152 to dynamically cut wind noise. Similarly, based on the coefficient notified by the control section 162, the coefficient creating section 163 creates integration coefficients for the first integrator section 118 and the second integrator section 123. The created integration coefficients are supplied to the first integrator section 118 and second integrator section 123 to cut wind noise at an arbitrary level.

The DSP 160 according to this embodiment having described above can cut noise at a desired lower frequency by deploying high-pass filters and integrator sections. Since a feedback loop is formed by the noise detecting section 161, control section 162 and coefficient creating section 163, the high pass filters and all-pass filter and integration coefficients can be changed dynamically when the noise level is high. Therefore, even sporadic noise or noise at a low frequency can be efficiently removed, which is an advantage.

This embodiment is configured to remove detected noise from audio signals of only three channels though five channel audio signals are generated. This configuration advantageously allows recording of clear audio signals at low costs from which unnecessary wind noise has been removed.

The imaging apparatus according to the first to fourth embodiments having described above allows recording in surround sound for multiple channels by using three omni-directional microphones only. By adding and subtracting audio signals collected by the three omni-directional microphones, an audio signal having an omni-directivity in the whole circumferential direction, an audio signal having bidirectivity in the right-left direction and an audio signal having a bidirectivity in the front-back direction are generated. By multiplying these audio signals by predetermined coefficients and adding the results, a unidirectional audio signal is synthesized, and multi-channel recording in surround sound can be implemented. An omni-directional microphone is inexpensive, and only three microphones are enough though in the past the same number of microphones as the number of channels to be recorded have been prepared, which may advantageously contribute to the reduction of the entire costs.

The three omni-directional microphones may be laid out in any triangular form where the distance between the microphones can be regarded as sufficiently smaller than the wavelength of sound. In other words, the three microphones 101 to 103 may be placed in any location except on one straight line. Multiple channel audio recording is allowed without changing the physical layout of microphones such as the distance between microphones and the form of the triangle. Therefore, the audio recording is independent of the form of the implementation surface of microphones to be implemented to an imaging apparatus. As a result, the constraints for places where microphones are to be mounted can be advantageously eased.

The direction of the maximum directional sensitivity of the unidirectivity can be defined to an arbitrary direction. Therefore, the number of directions of a maximum unidirectivity is not limited. By changing the synthesis ratio between a bidirectivity and an omni-directivity, a desired unidirectivity and a maximum directivity angle can be obtained only by defining a coefficient. This is also applicable to multi-channel recording by adding the similar circuits as a desired number of channels. Since the form of the unidirectivity can be changed only by defining a coefficient, the number of parts can be reduced, which can advantageously reduce costs.

The directional sensitivities of audio signals having bidirectivities in the right-left and front-back directions are adjusted in accordance with the maximum directional sensitivity of an omni-directional audio signal. Therefore, the level of an audio signal to be recorded is not unnecessarily too low or too high, and an audio signal with energy averaged among three microphones can be advantageously recorded.

The first integrator section 118 and the second integrator section 123 are placed after the first subtractor section 115 and the second subtractor section 120, respectively. Therefore, even when the low frequency band falls down to a degree that the audio signal is regarded as a primary differentiation in the subtractor sections, the low frequency band of the frequency characteristic can be raised to a flat characteristic by the integrator sections. As a result, the audio signal of the low frequency band can be advantageously recorded.

Having described the example in which the audio signal processing circuit included in an imaging apparatus is applied to a DSP according to the first to fourth embodiments, also in embodiments excluding a DSP the configurations can be implemented. The DSP may be implemented in other electronic machines.

The layout of microphones is not easily restricted since a unidirectivity can be synthesized with a reduced mount area for the microphones, and omni-directional microphones are used for audio recording. Therefore, the degree of flexibility in design is great, and the invention is applicable to a digital video camera, a digital still camera, a conference system and so on.

Figure 21:
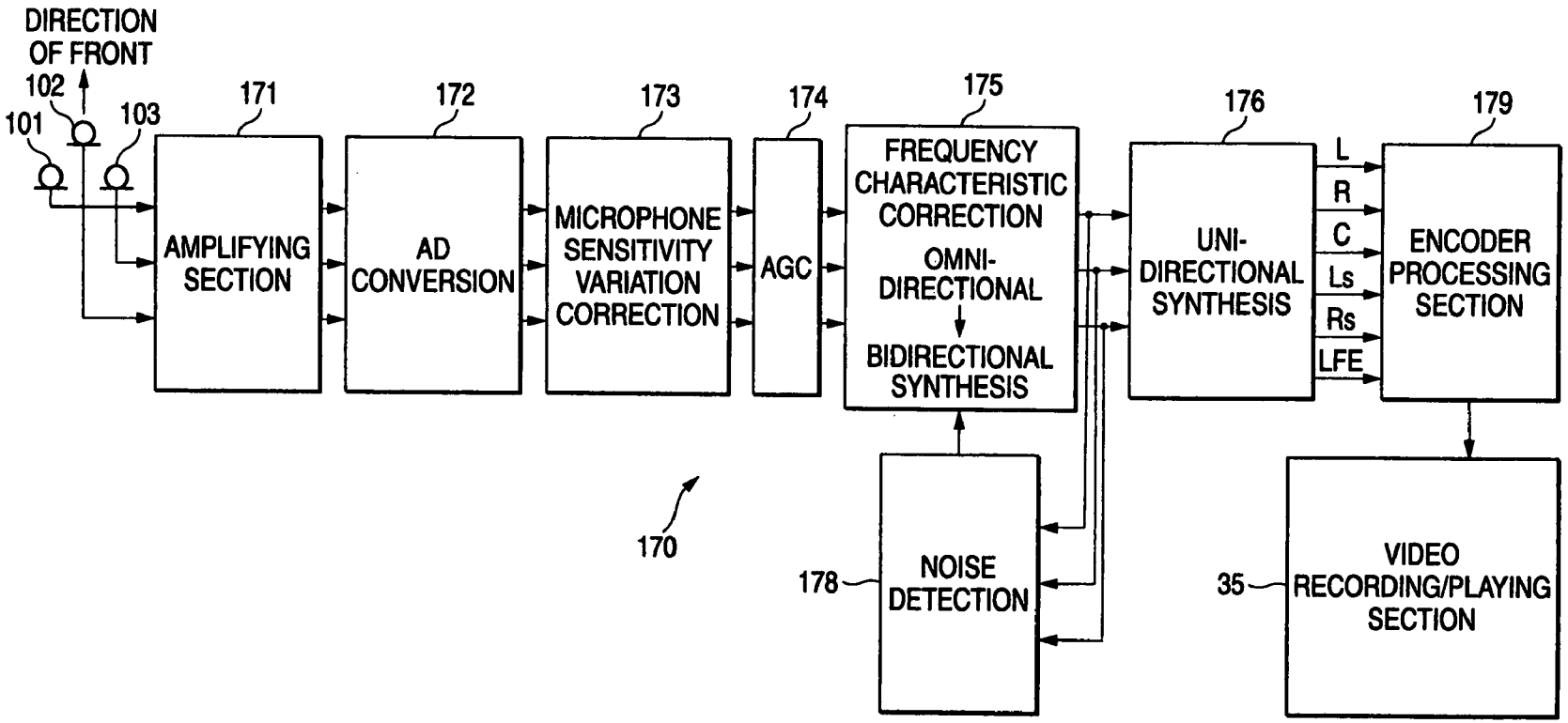
FIG. 21 is a block diagram showing an internal configuration example of a DSP according to another embodiment of the invention.

With reference to the block diagram in FIG. 21, an internal configuration example of a DSP 170 as a variation example of the invention will be described in which an automatic gain control section is added in order to implement recording in surround sound. Analog audio signals output by the omni-directional microphones 101 to 103 are amplified to a desired level by an amplifier section 171, which amplifies a signal. The amplified analog audio signals are converted to digital audio signals by an A/D converting section 172, which converts an analog signal to a digital signal. A microphone sensitivity variation correcting section 173, which corrects a variation in sensitivity among the microphones 101 to 103, absorbs a variation in microphone sensitivity by performing multiplication by a predetermined coefficient thereon. An automatic gain control (AGC) section 174, which performs gain adjustment, level-compresses the digital audio signals as a desired characteristic.

The automatic gain control section 174 predefines a reference input level for input audio signals, and an audio signal input near the reference input level is output as it is. If the level of an input audio signal is lower than the reference input level, it is regarded as a silent pause, and an audio signal with reduced noise and unnecessary background sound is output. On the other hand, if the level of an input audio signal is higher than the reference input level, an audio signal with a lower level than the level of the input audio signal is output so as to prevent an excessively large sound volume. A large input audio signal, which occurs sporadically, is output with the level reduced to a predetermined threshold value for preventing clipping. The audio signal output from the automatic gain control section 174 is corrected in frequency through a correcting circuit 175, which corrects a frequency characteristic, and bidirectional audio signals are synthesized. The feedback loop formed by the frequency characteristic correcting section 175, a noise detecting section 178 and a unidirectivity synthesizing section 176 dynamically cuts detected noise. The audio signal from which noise has been cut is handled by the unidirectivity synthesizing section 176 as a unidirectional audio signal in accordance with a desired channel. An audio signal processed by an encoder processing section 179, which performs predetermined compression processing, is supplied to the video recording/playing section 35. In this way, by inserting the automatic gain control section 174, audio signals can be recorded with the level kept within a predetermined range. Therefore, a listener can easily listen to the played audio, advantageously.

It should be understood by those skilled in the art that various modifications, combinations, sub-combinations and alterations may occur depending on design requirements and other factors insofar as they are within the scope of the appended claims or the equivalents thereof.

What is claimed is:

1. An audio signal processing apparatus comprising:

first, second and third omni-directional microphones each of which receives sound and generates an omni-directional audio signal and which are spaced apart by a predetermined distance;

a first adder section that adds audio signals generated by the first, second and third omni-directional microphones and generates an audio signal having an omni-directivity in the whole circumferential direction;

a first subtractor section that subtracts audio signals generated by the first and third omni-directional microphones and generates an audio signal having a directivity in the right-left direction;

a second adder section that adds audio signals generated by the first and third omni-directional microphones;

a second subtractor section that subtracts an audio signal generated by the second omni-directional microphone from the audio signal added by the second adder section and generates an audio signal having a directivity in the front-back direction; and an output section that adds the audio signal resulting from the multiplication of the audio signal having a directivity in the whole circumferential direction by a predetermined coefficient, the audio signal resulting from the multiplication of the audio signal having a directivity in the right-left direction by a predetermined coefficient, and the audio signal resulting from the multiplication of the audio signal having a directivity in the front-back direction by a predetermined coefficient and generates a unidirectional audio signal.

2. The audio signal processing apparatus according to claim 1, wherein the directional sensitivities of the audio signals having directivities in the right-left and front-back directions are adjusted in accordance with a maximum directional sensitivity of the omni-directional audio signal.

3. The audio signal processing apparatus according to claim 1, wherein the first, second and third omni-directional microphones are spaced apart by a distance, which can be regarded as being sufficiently smaller than the wavelength of sound, and are laid out in a triangular form.

4. The audio signal processing apparatus according to claim 1, further comprising:

a first integrator section after the first subtractor section, the first integrator section raising a low frequency band of the audio signal having a directivity in the right-left direction; and a second integrator section after the second subtractor section, the second integrator section raising a low frequency band of the audio signal having a directivity in the front-back direction.

5. The audio signal processing apparatus according to claim 1, wherein a plurality of the output sections are provided.

6. The audio signal processing apparatus according to claim 1, further comprising a multiplier section that corrects a variation in sensitivity of the first, second and third omni-directional microphones.

7. The audio signal processing apparatus according to claim 1, further comprising:

a first high-pass filter after the first subtractor section, the first high-pass filter only allowing a high frequency band of the audio signal having the directivity in the right-left direction to pass through;

a second high-pass filter after the second subtractor section, the second high-pass filter only allowing a high frequency band of the audio signal having the directivity in the front-back direction to pass through; and an all-pass filter after the first adder section, the all-pass filter bringing the phase of the omni-directional audio signal into the phase of the audio signals having the directivities in the right-left and front-back directions having passed the high-pass filters.

8. The audio signal processing apparatus according to claim 7, further comprising:

a noise detecting section that detects noise from the audio signals output by the first and second integrator sections and the audio signal output by the all-pass filter;

a control section that calculates a cutoff coefficient and an integration coefficient based on the noise detected by the noise detecting section; and a coefficient generating section that supplies the cutoff coefficient generated based on the calculation by the control section to the first and second high-pass filters and the all-pass filter and supplies the integration coefficient generated based on the control by the control section to the first and second integrator sections.

* * * * *